US009778584B2

(12) United States Patent
Matsushita et al.

(10) Patent No.: US 9,778,584 B2
(45) Date of Patent: Oct. 3, 2017

(54) TONER FOR DEVELOPING ELECTROSTATIC CHARGE IMAGE, ELECTROSTATIC CHARGE IMAGE DEVELOPER, TONER CARTRIDGE, PROCESS CARTRIDGE, IMAGE FORMING APPARATUS, AND IMAGE FORMING METHOD

(71) Applicant: FUJI XEROX CO., LTD., Tokyo (JP)

(72) Inventors: Emi Matsushita, Minamiashigara (JP); Fusako Kiyono, Minamiashigara (JP); Shintaro Anno, Minamiashigara (JP); Hiroki Omori, Minamiashigara (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/829,150

(22) Filed: Aug. 18, 2015

(65) Prior Publication Data

US 2016/0246197 A1 Aug. 25, 2016

(30) Foreign Application Priority Data

Feb. 25, 2015 (JP) ..... 2015-035867
Feb. 25, 2015 (JP) ..... 2015-035868

(51) Int. Cl.
*G03G 9/097* (2006.01)
*G03G 9/087* (2006.01)
*G03G 9/08* (2006.01)

(52) U.S. Cl.
CPC ..... *G03G 9/08755* (2013.01); *G03G 9/0819* (2013.01); *G03G 9/09733* (2013.01); *G03G 9/09775* (2013.01); *G03G 9/09791* (2013.01)

(58) Field of Classification Search
CPC ..... G03G 9/09791; G03G 9/09775; G03G 9/09733; G03G 9/0819; G03G 15/08
USPC ..... 430/108.3, 108.1, 110.4
See application file for complete search history.

(56) References Cited

U.S. PATENT DOCUMENTS

2004/0110077 A1 6/2004 Yachi et al.
2006/0045571 A1* 3/2006 Matsuura ..... G03G 21/0064 399/149

FOREIGN PATENT DOCUMENTS

JP H05-323653 A 12/1993
JP H08-202075 A 8/1996
JP 2002-207315 A 7/2002
JP 2007-279244 A 10/2007
JP 2008-293039 A 12/2008
JP 2014-115476 A 6/2014

* cited by examiner

*Primary Examiner* — Janis L Dote
(74) *Attorney, Agent, or Firm* — Oliff PLC

(57) ABSTRACT

According to one example of the present application, there is provided a toner for developing an electrostatic charge image, containing: a toner particle containing a binder resin; a particle adhering to a surface of the toner particle; and an elastomer particle containing one or more kinds of oil, wherein a volume particle size distribution index $GSD_T$ ($D50_T/D16_T$) on a small diameter side of the toner particle and a volume particle size distribution index $GSD_E$ ($D50_E/D16_E$) on a small diameter side of the elastomer particle satisfy Formula (1):

$$GSD_E/GSD_T \geq 1. \quad \text{Formula (1):}$$

15 Claims, 2 Drawing Sheets

TONER FOR DEVELOPING ELECTROSTATIC CHARGE IMAGE, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATION(S)

This application is based on and claims priority under 35 U.S.C. 119 from Japanese Patent Application Nos. 2015-035867 filed on Feb. 25, 2015, and 2015-035868 filed on Feb. 25, 2015.

BACKGROUND

1. Technical Field

The present invention relates to a toner for developing an electrostatic charge image, an electrostatic charge image developer, a toner cartridge, a process cartridge, an image forming apparatus, and an image forming method.

2. Background Art

A method for visualizing image information via an electrostatic charge image, such as electrophotography, is currently used in a variety of fields. In the electrophotography, an electrostatic charge image which is formed on a photoreceptor by a charging step and an electrostatic charge image forming step is developed by a developer containing a toner, and visualized through a transfer step and a fixing step.

SUMMARY

According to one aspect of the invention there is provided a toner for developing an electrostatic charge image, including:

a toner particle containing a binder resin;

a particle adhering to a surface of the toner particle; and an elastomer particle containing one or more kinds of oil, wherein a volume particle size distribution index $GSD_T$ ($D50_T/D16_T$) on a small diameter side of the toner particle and a volume particle size distribution index $GSD_E$ ($D50_E/D16_E$) on a small diameter side of the elastomer particle satisfy Formula (1):

$$GSD_E/GSD_T \geq 1 \quad \text{Formula (1):}$$

wherein in a volume particle size distribution of the toner particle, a particle diameter at which a cumulative percentage drawn from the small diameter side becomes 16% is defined as a volume particle diameter $D16_T$, and a particle diameter at which the cumulative percentage drawn from the small diameter side becomes 50% is defined as a volume particle diameter $D50_T$; and in a volume particle size distribution of the elastomer particle, the particle diameter at which a cumulative percentage drawn from the small diameter side becomes 16% is defined as a volume particle diameter $D16_E$, and a particle diameter at which the cumulative percentage drawn from the small diameter side becomes 50% is defined as a volume particle diameter $D50_E$.

BRIEF DESCRIPTION OF THE DRAWINGS

Exemplary embodiments of the present invention will de described in detail based on the following figures, wherein.

DETAILED DESCRIPTION

Figure 1:
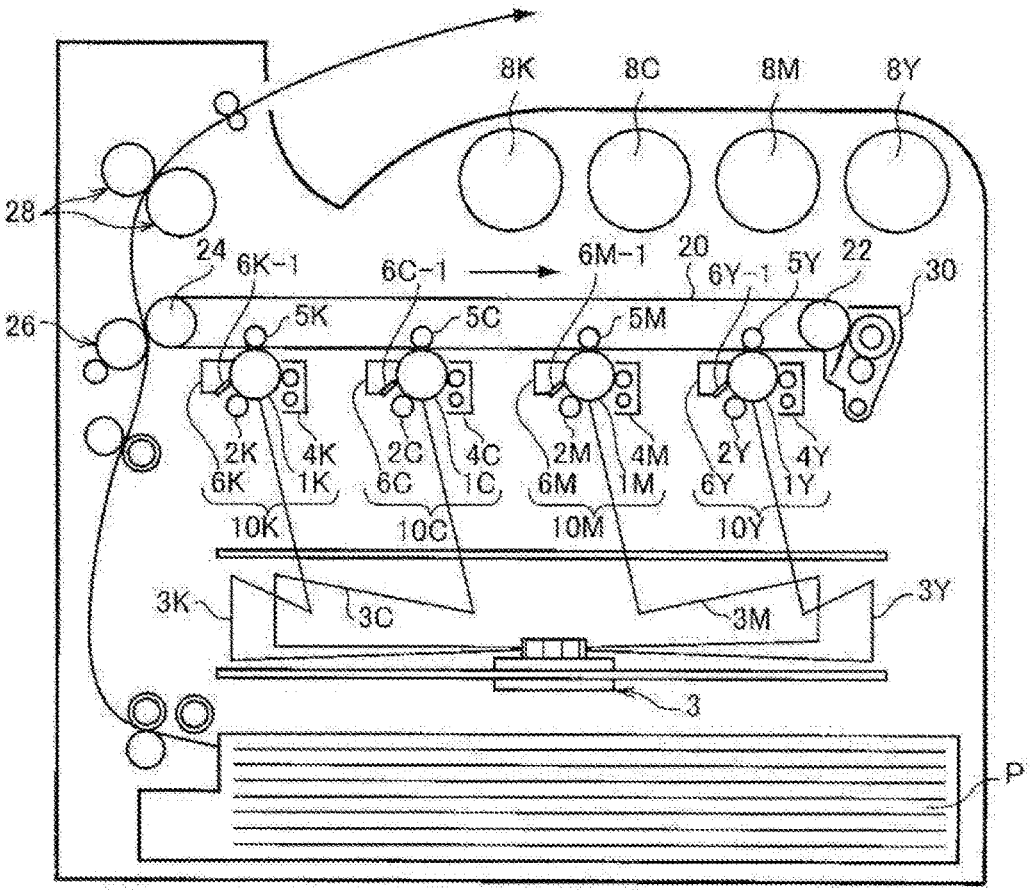
FIG. 1 is a schematic configuration diagram showing an example of an image forming apparatus according the present embodiment.

Hereinafter, a first embodiment which is one example of the present invention will be described in detail.

<Toner for Developing Electrostatic Charge Image>

A toner for developing an electrostatic charge image according to the first embodiment (which will be hereinafter simply referred to as a "toner") is a toner for developing an electrostatic charge image, including toner particles containing a binder resin, particles adhering to the surface of the toner particles (which will be hereinafter referred to as an "external additive" for convenience), and elastomer particles containing one or more kinds of oil (which will be hereinafter referred to as "elastomer particles"), in which when in the volume particle size distribution of the toner particles, the particle diameter at which the cumulative percentage drawn from the small diameter side becomes 16% is defined as a volume particle diameter $D16_T$, and the particle diameter at which the cumulative percentage drawn from the small diameter side becomes 50% is defined as a volume particle diameter $D50_T$; and in the volume particle size distribution of the elastomer particles, the particle diameter at which a cumulative percentage drawn from the small diameter side becomes 16% is defined as a volume particle diameter $D16_E$, and the particle diameter at which the cumulative percentage drawn from the small diameter side becomes 50% is defined as a volume particle diameter $D50_E$, the volume particle size distribution index $GSD_T$ ($D50_T/D16_T$) on the small diameter side of the toner particles and the volume particle size distribution index $GSD_E$ ($D50_E/D16_E$) on the small diameter side of the elastomer particles satisfy the following Formula (1).

$$GSD_E/GSD_T \geq 1 \quad \text{Formula (1):}$$

By making the volume particle size distribution index $GSD_T$ ($D50_T/D16_T$) on the small diameter side of the toner particles and the volume particle size distribution index $GSD_E$ ($D50_E/D16_E$) on the small diameter side of the elastomer particles satisfy Formula (1) in the toner according to the first embodiment, cleaning failure occurring at a time of forming an image is inhibited.

The reason for this is not clear, but it is presumably due to the following reason.

In the electrophotographic image forming apparatus, a residual toner which has not been transferred to an image holding member is subjected to cleaning with a cleaning blade on an image holding member (for example, a photoreceptor).

One of the toners in the related art is a toner including elastomer particles containing toner particles, an external additive, and an oil. In the case of forming an image using this toner, when the residual toner reaches a contact unit (which will be hereinafter referred to as a "cleaning unit") between a cleaning blade and an image holding member, a retained product (toner dam) including toner particles, an external additive, and elastomer particles is formed. Further, by applying pressure to the elastomer particles in the cleaning unit, the oil included in the elastomer particles is effused and supplied to the toner dam. As a result, in the cleaning unit, the aggregation force of the retained product in the toner dam increases, and it thus becomes easy to remove the residual toner.

Since a particle having a smaller particle diameter more easily reaches an edge portion of the cleaning unit, it becomes easy that a toner dam including a large amount of external additives having small particle diameters (which will also be hereinafter referred to as an "external additive dam") is formed in the edge portion (a side downstream to the rotation direction of the image holding member) of the cleaning unit, and a toner dam including a large amount of toner particles having large particle diameters (which will also be hereinafter referred to as a "toner particle dam") is formed on the side external to the edge portion of the cleaning unit (a side upstream to the rotation direction of the image holding member).

In the toner dam having such a distribution, the elastomer particles in the related art have a narrow volume particle diameter distribution, and as a result, they hardly reach the external additive dam, but reach the toner particle dam in most cases. As a result, the oil effused from the elastomer particles is supplied to the toner particle dam in most cases, and thus, the oil is hardly supplied to the external additive dam and the cleaning failure occurs in some cases.

Therefore, in the toner according to the first embodiment, the volume particle size distribution of the elastomer particles is set to be equivalent to the volume particle size distribution of the toner particles or to be larger than the volume particle size distribution of the toner particles. Specifically, the volume particle size distribution index $GSD_T$ ($D50_T/D16_T$) on the small diameter side of the toner particles and the volume particle size distribution index $GSD_E$ ($D50_E/D16_E$) on the small diameter side of the elastomer particles are controlled to satisfy $GSD_E/GSD_T \geq 1$.

Here, the significance of satisfying $GSD_E/GSD_T \geq 1$ will be described. The volume particle size distribution index on the small diameter side is an index that indicates the spreading extent of the distribution of the volume particle diameters. The higher distribution value indicates a wider volume particle diameter distribution. That is, a value of $GSD_E/GSD_T$ of 1 or more means that the spreading of the volume particle diameter distribution of the elastomer particles is equivalent to that of the volume particle size distribution of the toner particles or is wider than that of the volume particle size distribution of the toner particles. That is, since the elastomer particles are constituted with particles having a wider distribution ranging from small particle diameters to large particle diameters, as compared with the toner particles, the elastomer particles on the small particle diameter side more easily reach the edge portion of the cleaning unit than the toner particles. As a result, it becomes easy that the elastomer particles having small particle diameters reach the external additive dam, whereas the elastomer particles on the side of the large particle diameters reach the toner particle dam. Accordingly, in the case of forming an image, even when the amount of the toner supplied itself is small, the elastomer particles easily reach across the entire region of the toner dam ranging from an edge of the cleaning unit to the external side, and thus, the oil effused from these particles is also easily supplied. As a result, the aggregation force of the retained product in the entire toner dam increases, and thus, the cleaning function in the cleaning unit is easily enhanced.

From the above description, when the toner according to the first embodiment is applied to an image forming apparatus, cleaning failure occurring at a time of forming an image is inhibited. Further, due to the inhibition of the cleaning failure, image defects due to the cleaning failure are also inhibited.

Hereinafter, the details of the toner according to the first embodiment will be described.

(Volume Particle Size Distribution of Toner Particles)

The volume particle diameter $D16_T$ of the toner particles is preferably from 2 μm to 7 μm, and more preferably from 3 μm to 6 μm, from the viewpoint of making it easy to control the volume particle size distribution index $GSD_T$ ($D50_T/D16_T$) on the small diameter side to a specific range.

The volume particle diameter $D50_T$ of the toner particles is preferably from 3 μm to 8 μm, and more preferably from 3 μm to 5 μm, from the viewpoint of making it easy to control the volume particle size distribution index $GSD_T$ ($D50_T/D16_T$) on the small diameter side to a specific range.

The volume particle size distribution index $GSD_T$ ($D50_T/D16_T$) on the small diameter side of the toner particles is preferably from 1.1 to 1.4 from the viewpoint of satisfying Formula (1): $GSD_E/GSD_T \geq 1$.

Examples of the method for controlling the volume particle diameter $D16_T$, the volume particle diameter $D50_T$, and the volume particle size distribution index $GSD_T$ ($D50_T/D16_T$) on the small diameter side of the toner particles to the ranges above include a method for adjusting the granulation conditions (a temperature, time, a pH in a system, amounts of various additives to be added, and the like) of toner particles in the case of preparing the toner particles by a wet process; and a method of adjusting toner particles by classification.

The volume particle diameter $D16_T$, the volume particle diameter $D50_T$, and the volume particle size distribution index $GSD_T$ ($D50_T/D16_T$) on the small diameter side of the toner particles are measured by the method as shown below.

100 primary particles of the toner particles are observed by a scanning electron microscope (SEM) device (S-4100, manufactured by Hitachi, Ltd.) to capture images, the images are inserted into an image analysis device (LUZEXIII, manufactured by NIRECO Corp.) to measure the longest diameter and the shortest diameter per particle by the image analysis of the primary particles, and thus, a circle-corresponding diameter is determined from the median value. A diameter (D16v) reaching 16% in the cumulative frequency of the obtained circle-corresponding diameters is defined as a volume average particle diameter $D16_T$ of the toner particles, and a diameter (D50v) reaching 50% in the cumulative frequency of the obtained circle-corresponding diameters is defined as a volume average particle diameter $D50_T$ of the toner particles. Further, the magnification of the electron microscope is adjusted to cover about 10 to 50 toner particles per view, and the visual observations conducted plural times are combined to determine the circle-corresponding diameter of the primary particles. Further, the volume particle size distribution index $GSD_T$ ($D50_T/D16_T$) on the small diameter side is calculated from the measured volume particle diameter $D16_T$ and volume particle diameter $D50_T$.

(Volume Particle Size Distribution of Elastomer Particles)

The volume particle diameter $D16_E$ of the elastomer particles is preferably from 3 μm to 10 μm, and more preferably from 3 μm to 6 μm, from the viewpoint of making it easy to control the volume particle size distribution index $GSD_E$ ($D50_E/D16_E$) on the small diameter side to a specific range.

The volume particle diameter $D50_E$ of the elastomer particles is preferably from 5 μm to 15 μm, and more preferably from 5 μm to 8 μm, from the viewpoint of making it easy to control the volume particle size distribution index $GSD_E$ ($D50_E/D16_E$) on the small diameter side to a specific range.

The volume particle size distribution index $GSD_E$ ($D50_E/D16_E$) on the small diameter side of the elastomer particles is preferably from 1.2 to 2.3 from the viewpoint of satisfying Formula (1): $GSD_E/GSD_T \geq 1$.

Examples of the method for controlling the volume particle diameter $D16_E$, the volume particle diameter $D50_E$, and the volume particle size distribution index $GSD_E$ ($D50_E/D16_E$) on the small diameter side to the ranges above include a method of adjusting the polymerization conditions (a temperature, time, atmosphere, and the like) during the polymerization of the elastomer particles; and a method of adjusting the elastomer particles by classification.

The volume particle diameter $D16_E$, the volume particle diameter $D50_E$, and the volume particle size distribution index $GSD_E$ ($D50_E/D16_E$) on the small diameter side of the elastomer particles are measured by the method as shown below.

100 primary particles of the elastomer particles are observed by a scanning electron microscope (SEM) device (S-4100, manufactured by Hitachi, Ltd.) to capture images, the images are inserted into an image analysis device (LUZEXIII, manufactured by NIRECO Corp.) to measure the longest diameter and the shortest diameter per particle by the image analysis of the primary particles, and thus, a circle-corresponding diameter is determined from the median value. A diameter (D16v) reaching 16% in the cumulative frequency of the obtained circle-corresponding diameters is defined as a volume particle diameter $D16_E$ of the elastomer particles, and a diameter (D50v) reaching 50% in the cumulative frequency of the obtained circle-corresponding diameters is defined as a volume particle diameter $D50_E$ of the elastomer particles. Further, the magnification of the electron microscope is adjusted to cover about 10 to 50 elastomer particles per view, and the visual observations conducted plural times are combined to determine the circle-corresponding diameter of the primary particles. Further, the volume particle size distribution index $GSD_E$ ($D50_E/D16_E$) on the small diameter side is calculated from the measured volume particle diameter $D16_E$ and volume particle diameter $D50_E$.

($GSD_E/GSD_T$)

The volume particle size distribution index $GSD_T$ ($D50_T/D16_T$) on the small diameter side of the toner particles and the volume particle size distribution index $GSD_E$ ($D50_E/D16_E$) on the small diameter side of the elastomer particles satisfy the following Formula (1). As a result, the volume particle size distribution of the elastomer particles is equivalent to the volume particle size distribution of the toner particles or is wider than the volume particle size distribution of the toner particles, and thus, the cleaning function in the cleaning unit is easily enhanced. However, the upper limit of $GSD_E/GSD_T$ is not particularly limited from the viewpoint that the volume particle size distribution of the elastomer particles is wider than the volume particle size distribution of the toner particles, but it is preferably 2.5 or less from the viewpoint of the preparation.

$$GSD_E/GSD_T \geq 1 \quad \text{Formula (1):}$$

Moreover, the volume particle size distribution index $GSD_T$ on the small diameter side of the toner particles and the volume particle size distribution index $GSD_E$ on the small diameter side of the elastomer particles preferably satisfy the following Formula (12), and more preferably satisfy the following Formula (13), from the viewpoint of more easily enhancing the cleaning function in the cleaning unit.

$$1.0 \leq GSD_E/GSD_T \leq 2.0 \quad \text{Formula (12):}$$

$$1.0 \leq GSD_E/GSD_T \leq 1.6 \quad \text{Formula (13):}$$

($D50_E/D50_T$)

The volume particle diameter $D50_T$ of the toner particles and the volume particle diameter $D50_E$ of the elastomer particles preferably satisfy the following Formula (2).

$$0.8 \leq D50_E/D50_T \leq 2 \quad \text{Formula (2):}$$

Here, the significance of satisfying $0.8 \leq D50_E/D50_T \leq 2$ will be described. $D50_E/D50_T$ in the range above means that the volume particle diameter $D50_E$ of the elastomer particles is from a range slightly smaller than the volume particle diameter $D50_T$ of the toner particles to a range of size twice the volume particle diameter $D50_T$ of the toner particles.

When the elastomer particles have too large volume particle diameters $D50_E$ with respect to the toner particles, they hardly reach the external additive dam, whereas when the elastomer particles have too small volume particle diameters $D50_E$ with respect to the toner particles, they hardly reach the toner dam. Therefore, by satisfying Formula (2), the elastomer particles more easily reach both the external additive dam and the toner dam, and accordingly, the oil effused from the elastomer particles is also easily supplied. As a result, it is considered that the strength of the external additive dam and the toner dam increases, the aggregation force of the retained product increases, and accordingly, the cleaning function in the cleaning unit is enhanced.

Moreover, the volume particle diameter $D50_T$ of the toner particles and the volume particle diameter $D50_E$ of the elastomer particles preferably satisfy the following Formula (22) from the viewpoint of further enhancing the cleaning function in the cleaning unit.

$$1.0 \leq D50_E/D50_T \leq 1.5 \quad \text{Formula (22):}$$

Hereinafter, the details of the toner according to the first embodiment will further be described.

The toner according to the first embodiment has toner particles, adhesive particles (external additive) adhered to the surface of the toner particles, and elastomer particles containing one or more kinds of oil.

(Elastomer Particles)

The elastomer particles in the first embodiment contain one or more kinds of oil. The material of the elastomer particles (the elastomer particles before incorporating an oil thereinto) is not particularly limited as long as it has a property of being distorted by external force and restored from its distortion by the removal of the external force, that is, it is a so-called elastomer. Examples thereof include various known elastomers, and specifically, synthetic rubber such as urethane rubber, silicone rubber, fluorine rubber, chloroprene rubber, butadiene rubber, ethylene-propylene-diene copolymerization rubber (EPDM), and epichlorohydrin rubber, and synthetic resins such as polyolefin, polystyrene, and polyvinyl chloride.

However, for the elastomer particles containing an oil, it is suitable to supply an oil to the elastomer particles when the elastomer particles are squeaked under a cleaning blade. As a result, the elastomer particles containing an oil are preferably porous elastomer particles containing an oil.

Since the porous elastomer particles (porous elastomer particles before incorporating an oil thereinto) include an oil, the particles may be particles having plural pores on at least the particle surface, and the specific surface area of the porous elastomer particles is preferably from 0.1 $m^2/g$ to 25 $m^2/g$, more preferably from 0.3 $m^2/g$ to 20 $m^2/g$, and still more preferably from 0.5 $m^2/g$ to 15 $m^2/g$. If it is within the range above, it is easy to impregnate an oil in the porous elastomer particles.

The specific surface area of the porous elastomer particles is measured by using a BET method.

Specifically, by using porous elastomer particles separated from a toner, 0.1 g of a sample to be measured is precisely weighed by a device that measures a specific surface area and a pore distribution (SA3100, manufactured by Beckman Coulter, Inc.), put into a sample tube, and subjected to a degassing treatment and to automatic measurement by a multi-point method.

The oil contained in the elastomer particles may be any one which is a compound having a melting point of lower than 20° C., that is, a compound being liquid at 20° C., and examples thereof include various known silicone oils or lubricant oils. Further, the boiling point of the oil is preferably 150° C. or higher, and more preferably 200° C. or higher.

Furthermore, one kind or two or more kinds of the oils may be contained in the elastomer particles.

The oil is preferably a silicone oil.

Examples of the silicone oil include silicone oils such as dimethylpolysiloxane, diphenyl polysiloxane, and phenylmethylpolysiloxane, and reactive silicone oils such as amino-modified polysiloxane, epoxy-modified polysiloxane, carboxyl-modified polysiloxane, carbinol-modified polysiloxane, fluorine-modified polysiloxane, methacryl-modified polysiloxane, mercapto-modified polysiloxane, and phenol-modified polysiloxane. Among these, dimethylpolysiloxane (which is also called a "dimethylsilicone oil") is particularly preferable.

Furthermore, an oil having a polarity opposite to that of the adhesive particles (external additive) adhering to the surface of the toner particles may be used. Examples of the oil having a polarity opposite to that of the adhesive particles include positively chargeable oils such as a monoamine-modified silicone oil, a diamine-modified silicone oil, an amino-modified silicone oil, and an ammonium-modified silicone oil; and negatively chargeable oils such as a dimethylsilicone oil, an alkyl-modified silicone oil, an α-methylsulfone-modified silicone oil, a chlorophenylsilicone oil, and a fluorine-modified silicone oil.

The content of the elastomer particles is preferably from 0.05 parts by mass to 5 parts by mass, more preferably from 0.1 parts by mass to 3 parts by mass, and still more preferably from 0.1 parts by mass to 2 parts by mass, with respect to 100 parts by mass of the toner particles.

The total content of oils in the elastomer particles is preferably from 0.01 mg to 100 mg, more preferably from 0.05 mg to 50 mg, and still more preferably from 0.1 mg to 30 mg, with respect to 1 g of the toner.

The total content of oils in the elastomer particles in the toner is measured by subjecting the elastomer particles to ultrasonic wave-washing (an output of 60 W, a frequency of 20 kHz, for 30 minutes) in hexane, filtering the washing liquid to remove the oil, which operation is repeated five times, and then vacuum-drying the residue at 60° C. for 12 hours. In addition, the oil content in the elastomer particles is calculated from the change in weights before and after the removal of an oil, and the total oil content with respect to 1 g of the toner is calculated from the amount of the elastomer particles to be added.

—Method for Preparing Elastomer Particles (Elastomer Particles Before Incorporating Oil Thereinto—

The method for preparing elastomer particles is not particularly limited, and known methods may be used therefor. Examples of the method include a method in which an elastomer material is processed into a particulate shape, and a method in which a pore forming agent is mixed with emulsified particles in the production of elastomers by emulsification polymerization, emulsification polymerization is carried out, and then the pore forming agent is removed. Among these, from the viewpoint that spherical particles are easily produced, a method in which a pore forming agent is mixed with emulsified particles in the production of elastomers by emulsification polymerization, emulsification polymerization is carried out, and then the pore forming agent is removed is preferred.

Examples of the pore forming agent include a compound which is solid during the emulsification polymerization and is removed by at least one of dissolution and decomposition after the emulsification polymerization, and diluents which are not involved in a polymerization reaction during the emulsification polymerization.

As the compound which is solid during the emulsification polymerization and is removed by at least one of dissolution and decomposition after the emulsification polymerization, calcium carbonate is preferred from the viewpoints of cost or easy availability. Calcium carbonate has low solubility in water, and is decomposed while discharging carbon dioxide when being brought into contact with an acidic liquid.

The diluent is not particularly limited, but preferable examples thereof include diethylbenzene and isoamyl alcohol.

Incidentally, the amount of the diluents used is preferably more than that of the polymerizable compound used.

The shape of the pore forming agent is preferably a particulate shape, and the number average particle diameter is preferably from 5 nm to 200 nm, and more preferably from 5 nm to 100 nm.

In addition, the condition for the emulsification polymerization is not particularly limited, and the emulsification polymerization may be carried out under, for example, the same conditions as those of known emulsification polymerization except for using a pore forming agent.

—Method for Incorporating Oil into Elastomer Particles—

The method for incorporating an oil into the elastomer particles is not particularly limited, and preferable examples thereof include a method in which elastomer particles are brought into contact with an oil, and a method in which an oil is dissolved in an organic solvent, the solution is brought into contact with elastomer particles, and the organic solvent is removed.

The contacting may be carried out by a known method, and preferable examples thereof include a method in which elastomer particles are mixed with an oil or a solution of an oil, and a method in which elastomer particles are dipped in an oil or a solution of an oil.

The organic solvent is not particularly limited as long as it can dissolve an oil having a polarity opposite to that of the adhesive particles therein, but preferable examples thereof include hydrocarbon-based solvents and alcohols.

(Toner Particles)

The toner particles contain, for example, a binder resin, and if necessary, a colorant, a release agent, and other additives.

—Binder Resin—

Examples of the binder resin include vinyl-based resins formed of homopolymers of monomers such as styrenes (for example, styrene, parachlorostyrene, and α-methylstyrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene and butadiene), or copolymers obtained by combining two or more kinds of these monomers.

Additional examples of the binder resin include non-vinyl resins such as an epoxy resin, a polyester resin, a polyurethane resin, a polyamide resin, a cellulose resin, a polyether resin, and modified rosin, mixtures thereof with the vinyl resins as described above, or graft polymers obtained by polymerizing a vinyl monomer with the coexistence of such non-vinyl resins.

These binder resins may be used singly or in combination of two or more kinds thereof.

A polyester resin is suitable as the binder resin.

Examples of the polyester resin include known polyester resins.

Examples of the polyester resin further include a condensation polymer of a polyvalent carboxylic acid and a polyol, and further, a commercially available product or a synthesized product may be used as the polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, and lower alkyl esters (having 1 to 5 carbon atoms, for example) thereof. Among these, for example, aromatic dicarboxylic acids are preferable as the polyvalent carboxylic acid.

The polyvalent carboxylic acid may be used in combination with a tri- or higher-valent carboxylic acid employing a crosslinked structure or a branched structure, together with a dicarboxylic acid. Examples of the tri- or higher-valent carboxylic acid include trimellitic acid, pyromellitic acid, anhydrides thereof, and lower alkyl esters (having 1 to 5 carbon atoms, for example) thereof.

The polyvalent carboxylic acids may be used singly or in combination of two or more kinds thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferable, and aromatic diols are more preferable as the polyol.

The polyol may be used in combination with a tri- or higher-valent polyol employing a crosslinked structure or a branched structure, together with diols. Examples of the tri- or higher-valent polyol include glycerin, trimethylolpropane, and pentaerythritol.

The polyols may be used singly or in combination of two or more kinds thereof.

The glass transition temperature (Tg) of the polyester resin is preferably from 50° C. to 80° C., and more preferably from 50° C. to 65° C.

Incidentally, the glass transition temperature is determined from a DSC curve obtained by differential scanning calorimetry (DSC). More specifically, the glass transition temperature is determined from the "extrapolated glass transition onset temperature" described in the method of obtaining a glass transition temperature in the "Testing Methods for Glass Transition Temperatures of Plastics" in JIS K-1987.

The weight average molecular weight (Mw) of the polyester resin is preferably from 5000 to 1000000, and more preferably from 7000 to 500000.

The number average molecular weight (Mn) of the polyester resin is preferably from 2000 to 100000.

The molecular weight distribution Mw/Mn of the polyester resin is preferably from 1.5 to 100, and more preferably from 2 to 60.

Incidentally, the weight average molecular weight and the number average molecular weight of the resin are measured by gel permeation chromatography (GPC). The molecular weight measurement by GPC is performed using HLC-8120GPC, GPC manufactured by Tosoh Corporation, as a measuring device, TSKgel Super HM-M (15 cm), column manufactured by Tosoh Corporation, and THF as a solvent. The weight average molecular weight and the number average molecular weight are calculated using a molecular weight calibration curve plotted from a monodisperse polystyrene standard sample from the results of the above measurement.

The polyester resin is obtained by a known preparation method. Specific examples thereof include a method of conducting a reaction at a polymerization temperature set to from 180° C. to 230° C., if necessary, under reduced pressure in the reaction system, while removing water or an alcohol that is generated during condensation.

Incidentally, in the case where monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. In the case where a monomer having poor compatibility is present in a copolymerization reaction, the monomer having poor compatibility and an acid or an alcohol to be polycondensed with the monomer may be preliminarily condensed and then polycondensed with the major component.

The content of the binder resin is, for example, preferably from 40% by mass to 95% by mass, more preferably from 50% by mass to 90% by mass, and still more preferably from 60% by mass to 85% by mass, with respect to the entire toner particles.

—Colorant—

Examples of the colorant include pigments such as carbon black, chrome yellow, Hansa yellow, benzidine yellow, thuren yellow, quinoline yellow, pigment yellow, permanent orange GTR, pyrazolone orange, Balkan orange, watch young red, permanent red, brilliant carmin 3B, brilliant carmin 6B, DuPont oil red, pyrazolone red, lithol red, Rhodamine B Lake, Lake Red C, pigment red, rose bengal, aniline blue, ultramarine blue, chalco oil blue, methylene blue chloride, phthalocyanine blue, pigment blue, phthalocyanine green, and malachite green oxalate; and dyes such as acridine-based dyes, xanthene-based dyes, azo-based dyes, benzoquinone-based dyes, azine-based dyes, anthraquinone-based dyes, thioindigo-based dyes, dioxadine-based dyes, thiazine-based dyes, azomethine-based dyes, indigo-based dyes, phthalocyanine-based dyes, aniline black-based dyes, polymethine-based dyes, triphenylmethane-based dyes, diphenylmethane-based dyes, and thiazole-based dyes.

The colorants may be used singly or in combination of two or more kinds thereof.

As the colorant, a colorant which has been surface-treated, if necessary, may be used, and the colorant may be used in combination with a dispersant. Further, a combination of plural kinds of the colorants may be used.

The content of the colorant is, for example, preferably from 1% by mass to 30% by mass, and more preferably from 3% by mass to 15% by mass, with respect to the entire toner particles.

—Release Agent—

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

Further, the melting temperature is determined from a DSC curve obtained by differential scanning calorimetry (DSC), using the "melting peak temperature" described in the method of determining a melting temperature in the "Testing Methods for Transition Temperatures of Plastics" in JIS K-1987.

The content of the release agent is, for example, preferably from 1% by mass to 20% by mass, and more preferably from 5% by mass to 15% by mass, with respect to the entire toner particles.

—Other Additives—

Examples of other additives include known additives such as a magnetic material, a charge-controlling agent, and inorganic powder. These additives are included as internal additives in the toner particles.

—Characteristics or the Like of Toner Particles—

The toner particles may be toner particles having a monolayer structure, or toner particles having a so-called core-shell structure composed of a core (core particle) and a coating layer (shell layer) that is coated on the core.

Here, the toner particles having a core-shell structure may preferably be composed of, for example, a core configured to include a binder resin, and if necessary, other additives such as a colorant and a release agent, and a coating layer configured to include a binder resin.

A shape factor SF1 of the toner particles is preferably from 110 to 150, and more preferably from 120 to 140.

Furthermore, the shape factor SF1 is determined by the following equation:

$$SF1=(ML^2/A)\times(\pi/4)\times 100 \quad \text{Equation:}$$

In the equation, ML represents an absolute maximum length of a toner particles and A represents a projected area of a toner particles.

Specifically, the shape factor SF1 is calculated as follows mainly using a microscopic image or an image of a scanning electron microscope (SEM) that is analyzed using an image analyzer to be digitalized. That is, an optical microscopic image of particles sprayed on the surface of a slide glass is captured into an image analyzer LUZEX through a video camera, the maximum lengths and the projected areas of 100 particles are obtained for calculation using the equation above, and an average value thereof is obtained.

(Particles (External Additive) Adhering to Surface of Toner Particles)

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

It is preferable that the surfaces of the inorganic particles as the external additive are hydrophobization-treated. For example, the hydrophobization treatment is performed, by immersing the inorganic particles in a hydrophobization treatment agent. The hydrophobization treatment agent is not particularly limited and examples thereof include a silane-based coupling agent, silicone oil, a titanate-based coupling agent and an aluminum-based coupling agent. These may be used singly or in combination of two or more kinds thereof.

For example, the amount of the hydrophobization treatment agent is from 1 part by mass to 10 parts by mass with respect to 100 parts by mass of the inorganic particles.

Examples of the external additives also include resin particles (resin particles such as polystyrene, polymethyl methacrylate (PMMA), and a melamine resin) and cleaning activators (for example, a metal salt of higher fatty acid represented by zinc stearate and a particle of a fluorine-based polymer).

The amount of the external additive externally added is, for example, preferably from 0.01% by mass to 5% by mass, and more preferably from 0.01% by mass to 2.0% by mass, with respect to the toner particles.

Hereinafter, the second embodiment which is an example of the present invention will be described in detail.

<Toner for Developing Electrostatic Charge Image>

The toner for developing an electrostatic charge image according to the second embodiment (which will be hereinafter simply referred to as a "toner") has toner particles containing a binder resin, elastomer particles containing one or more kinds of oil, and fatty acid metal salt particles. Incidentally, in the second embodiment, unless otherwise specified, the elastomer particles containing one or more kinds of oil are simply referred to as "elastomer particles".

When the toner according to the second embodiment has the configuration above, the streak-shaped image defects due to a change in the posture of the cleaning blade are inhibited even though a low-intensity image is formed over a long period time and a high-intensity image is then formed.

The reason for this is not clear, but it is presumably due to the following reason.

In the electrophotographic image forming apparatus, a toner that is not transferred onto an image holding member and remains is cleaned by a cleaning blade on an image holding member (for example, a photoreceptor).

The toners in the related art may contain toner particles and fatty acid metal salt particles. When the fatty acid metal salt particles are supplied onto the image holding member, and the fatty acid metal salt particles reach a contact unit between a cleaning blade and an image holding member (which will also be hereinafter referred to as a "cleaning unit") and are squeaked, a coating film of the fatty acid metal salt is easily formed on an image holding member. Thus, the abrasion of the cleaning blade is inhibited. However, since the fatty acid metal salt particles are easily supplied to a non-image portion on the image holding member, when the low-intensity image is formed over a long period of time, excess of the fatty acid metal salt particles is easily supplied to the non-image portion on the image holding member and the cleaning blade in the non-image portion easily causes vibration or curling, or the like. Therefore, the posture of the cleaning blade is easily changed, and thus, the toner easily slips out. As a result, the streak-shaped image defects easily occur.

On the other hand, the toners in the related art may include ones including elastomer particles containing toner particles and an oil. When the elastomer particles reach a cleaning unit and are squeaked, the oil contained in the elastomer particles is effused and supplied to a cleaning unit. Thus, the cleaning properties of the residual toner increase. However, since the elastomer particles are easily supplied to a non-image portion in the image holding member, when the low-intensity image is formed over a long period of time, excess of the elastomer particles is easily supplied to the non-image portion on the image holding member and the lubricating properties of the non-image portion increase too much in some cases due to the oil effused from the elastomer particles. Therefore, the posture of the cleaning blade is easily changed, and thus, the toner easily slips out. As a result, when a low-intensity image is formed over a long period of time and then a high-intensity image is formed, the streak-shaped image defects easily occur.

Accordingly, in the second embodiment, a toner containing both the fatty acid metal salt particles and the elastomer particles in the toner particle is employed. Thus, even when a low-intensity image is formed over a long period of time and then a high-intensity image is formed, a change in the posture of the cleaning blade is inhibited, and thus, it becomes difficult for the toner to slip out.

Here, a mechanism in which a change in the posture of the cleaning blade is inhibited is presumed as follow. Since both of the fatty acid metal salt particles and the elastomer particles are supplied to the non-image portion on the image holding member, the fatty acid metal salt particles are squeaked under the cleaning unit. It is considered that when a coating is formed on the image holding member, the oil effused from the elastomer particles are sandwiched between the fatty acid metal salt particles. Further, it is considered that a pseudo lamination structure formed by alternate fatty acid metal salt-oil-fatty acid metal salt lamination is formed in the cleaning unit. Thus, the coating of the fatty acid metal salt is easily peeled off together with the oil from the image holding member by the lubricating action of the oil. As a result, even when excess of the fatty acid metal salt particles and the oil are supplied to the non-image portion on the image holding member, excess of the fatty acid metal salt and the oil are inhibited from being present in the non-image portion, and thus, it becomes difficult that the cleaning blade causes vibration, curling, or the like, and the toner slips out.

On the other hand, it is considered that the coating film of the fatty acid metal salt as described above is peeled off together with the oil from the top of the pseudo lamination structure. Thus, it is considered that the coating film of the fatty acid metal salt and the oil suitably remain on the non-image portion on the image holding member, and thus, the coating film of the fatty acid metal salt and the oil in the non-image portion are present in the suitable amounts. As a result, the lubricating properties in the non-image portion are secured.

From the above description, when the toner according to the present embodiment is applied to an image forming apparatus, even though a low-intensity image is formed over a long period of time and then a high-intensity image is formed, the streak-shaped image defects due to a change in the posture of the cleaning blade are inhibited.

Furthermore, if a low-intensity image is formed over long period of time, the toner is easily retained in a developer (an examples of the developing means), and is easily rubbed into a toner layer-regulating member (trimer portion) of the developer, and as a result, aggregates of the toner are easily formed in the developer. When the aggregates of the toner are developed in the image holding member, for example, distortion occurs among the image holding member-aggregates-transfer member (for example, an intermediate transfer member), and thus, white spot-shaped defects in an image, that is, white image defects outside the image easily occur. To the contrary, it is considered that by incorporating a fatty acid metal salt and an oil into the toner according to the second embodiment, the pseudo lamination structure is formed on the image portion on the image holding member as well as the non-image portion. Thus, it is considered that since the lubricating properties of the image holding member are suitably maintained, rubbing between the image holding member and the aggregates of the toner is inhibited, and thus, it becomes difficult that distortion between the image holding member-aggregates-transfer member occurs.

Therefore, when the toner according to the second embodiment is applied to the image forming apparatus, the occurrence of the white image defects is also inhibited.

Hereinafter, the details of the toner according to the second embodiment will be described.

The toner according to the second embodiment has toner particles, elastomer particles containing one or more kinds of oil, fatty acid metal salt particles, and if necessary, an external additive.

(Toner Particles)

The toner particles of the second embodiment are the same as the toner particles of the first embodiment. The toner particles include, for example, a binder resin, and if necessary, a colorant, a release agent, and other additives.

—Characteristics or the Like of Toner Particles—

The toner particles may be toner particles having a monolayer structure, or toner particles having a so-called core-shell structure composed of a core (core particle) and a coating layer (shell layer) that is coated on the core.

Here, the toner particles having a core-shell structure may preferably be composed of, for example, a core configured to include a binder resin, and if necessary, other additives such as a colorant and a release agent, and a coating layer configured to include a binder resin.

A shape factor SF1 of the toner particles is preferably from 110 to 150, and more preferably from 120 to 140.

Furthermore, the shape factor SF1 is determined by the following equation:

$$SF1=(ML^2/A)\times(\pi/4)\times 100 \quad \text{Equation:}$$

In the equation, ML represents an absolute maximum length of a toner particles and A represents a projected area of a toner particles.

Specifically, the shape factor SF1 is calculated as follows mainly using a microscopic image or an image of a scanning electron microscope (SEM) that is analyzed using an image analyzer to be digitalized. That is, an optical microscopic image of particles sprayed on the surface of a slide glass is captured into an image analyzer LUZEX through a video camera, the maximum lengths and the projected areas of 100 particles are obtained for calculation using the equation above, and an average value thereof is obtained.

—Volume Particle Size Distribution of Toner Particles—

The volume particle diameter $D16_T$ of the toner particles is preferably from 2 μm to 7 μm, and more preferably from 3 μm to 6 μm, from the viewpoint that the volume particle size distribution index $GSD_T$ ($D50_T/D16_T$) on the small diameter side is easily controlled to a specific range.

The volume particle diameter $D50_T$ of the toner particles is preferably from 3 μm to 8 μm, and more preferably from 3 μm to 5 μm, from the viewpoint that the volume particle size distribution index $GSD_T$ ($D50_T/D16_T$) on the small diameter side is easily controlled to a specific range.

The volume particle size distribution index $GSD_T$ ($D50_T/D16_T$) on the small diameter side of the toner particles is preferably from 1.1 to 1.4 from the viewpoint of satisfying Formula (1): $GSD_E/GSD_T1$ and Formula (3): $GSD_S/GSD_T \leq 1$.

Examples of the method for controlling the volume particle diameter $D16_T$, the volume particle diameter $D50_T$, and the volume particle size distribution index $GSD_T$ ($D50_T/D16_T$) on the small diameter side of the toner particles to the ranges above include a method of adjusting the granulation conditions (a temperature, time, a pH in a system, amounts of various additives, and the like) of the toner particles in the case of preparing the toner particles by a wet process; and a method of adjusting toner particles by classification.

The volume particle diameter $D16_T$, the volume particle diameter $D50_T$, and the volume particle size distribution index $GSD_T$ ($D50_T/D16_T$) on the small diameter side of the toner particles are measured by the method as shown below.

100 primary particles of the toner particles are observed by a scanning electron microscope (SEM) device (S-4100, manufactured by Hitachi, Ltd.) to capture images, the images are inserted into an image analysis device (LUZEXIII, manufactured by NIRECO Corp.) to measure the longest diameter and the shortest diameter per particle by the image analysis of the primary particles, and thus, a circle-corresponding diameter is determined from the median value. A diameter (D16v) reaching 16% in the cumulative frequency of the obtained circle-corresponding diameters is defined as a volume average particle diameter $D16_T$ of the toner particles, and a diameter (D50v) reaching 50% in the cumulative frequency of the obtained circle-corresponding diameters is defined as a volume average particle diameter $D50_T$ of the toner particles. Further, the magnification of the electron microscope is adjusted to cover about 10 to 50 toner particles per view, and the visual observations conducted plural times are combined to determine the circle-corresponding diameter of the primary particles. Further, the volume particle size distribution index $GSD_T$ ($D50_T/D16_T$) on the small diameter side is calculated from the measured volume particle diameter $D16_T$ and volume particle diameter $D50_T$.

—Relationship Between Volume Particle Size Distribution of Toner Particles and Volume Particle Size Distribution of Elastomer Particles, and Relationship Between Volume Particle Size Distribution of Toner Particles and Volume Particle Size Distribution of Fatty Acid Metal Salt Particles—

In the toner according to the second embodiment, it is preferable that the volume particle size distribution of the elastomer particles is equivalent to the volume particle size distribution of the toner particles, or is larger than the volume particle size distribution of the toner particles. Further, it is preferable that the volume particle size distribution of the fatty acid metal salt particles is equivalent to the volume particle size distribution of the toner particles, or is larger than the volume particle size distribution of the toner particles.

Specifically, it is preferably controlled that the volume particle size distribution index $GSD_T$ ($D50_T/D16_T$) on the small diameter side of the toner particles and the volume particle size distribution index $GSD_E$ ($D50_E/D16_E$) on the small diameter side of the elastomer particles satisfy the following Formula (1), and the volume particle size distribution index $GSD_T$ ($D50_T/D16_T$) on the small diameter side of the toner particles and the volume particle size distribution index $GSD_S$ ($D50_S/D16_S$) on the small diameter side of the fatty acid metal salt particles satisfy the following Formula (2).

$$GSD_E/GSD_T \leq 1 \quad \text{Formula (1):}$$

$$GSD_S/GSD_T \leq 1 \quad \text{Formula (3):}$$

Here, the significance of satisfying Formulae (1) and (3) will be described.

The volume particle size distribution index on the small diameter side is an index indicating the spreading extent of the distribution of the volume particle diameters. The higher value represents a wider distribution of the volume particle diameters. Thus, a value of $GSD_E/GSD_T$ of 1 or more means that the spreading of the volume particle diameter distribution of the elastomer particles is equivalent to the spreading of the volume particle size distribution of the toner particles, or is wider than the spreading of the volume particle size distribution of the toner particles. In the same manner, a value of $GSD_S/GSD_T$ of 1 or more means that the spreading of the volume particle diameter distribution of the fatty acid metal salt particles is equivalent to the spreading of the volume particle size distribution of the toner particles, or is wider than the spreading of the volume particle size distribution of the toner particles. That is, the elastomer particles and the fatty acid metal salt particles are constituted with particles having a wider distribution ranging from a small particle diameter to a large particle diameter, as compared with the toner particles. In a toner dam (toner reservoir) formed in the cleaning unit, as the particle diameter is smaller, the particles more easily reach the edge portion of the cleaning unit (side downstream to the rotation direction of the image holding member). As a result, the elastomer particles on the small particle diameter side and the fatty acid metal salt particle on the small particle diameter more easily reach the edge portion of the cleaning unit than the toner particles, and the elastomer particles on the large particle diameter side and the fatty acid metal salt particles on the large particle diameter side more easily reach the external side with respect to the edge portion of the cleaning unit.

Accordingly, it is considered that the fatty acid metal salt and the oil are dispersed over the entire region of the toner dam ranging from an edge of the cleaning unit to the external side, and a pseudo lamination structure formed by alternate lamination with fatty acid metal salt-oil-fatty acid metal salt is easily formed. Thus, in the case where a low-intensity image is formed over a long period time and a high-intensity image is then formed, it is considered that even when excess of fatty acid metal salt particles and an oil are supplied to a non-image portion on the image holding member, excess of the fatty acid metal salt and the oil are inhibited from being present on the non-image portion. As a result, it is considered that a change in the posture of the cleaning blade is more inhibited, and thus, streak-shaped image defects are inhibited.

However, the upper limit of $GSD_E/GSD_T$ is not particularly limited from the viewpoint that the volume particle size distribution of the elastomer particles is wider than the volume particle size distribution of the toner particles, but it is preferably 2.5 or less from the viewpoint of the preparation. The upper limit of $GSD_S/GSD_T$ is not particularly limited, but for the same reason, it is preferably 4.0 or less.

The volume particle size distribution index $GSD_T$ on the small diameter side of the toner particles and the volume particle size distribution index $GSD_E$ on the small diameter side of the elastomer particles more preferably satisfy the following Formula (12), and still more preferably satisfy the following Formula (13), from the viewpoint that the streak-shaped image defects due to a change in the posture of the cleaning blade are more inhibited.

$$1.0 \leq GSD_E/GSD_T \leq 2.0 \quad \text{Formula (12):}$$

$$1.0 \leq GSD_E/GSD_T \leq 1.6 \quad \text{Formula (13):}$$

Furthermore, the volume particle size distribution index $GSD_T$ on the small diameter side of the toner particles and the volume particle size distribution index $GSD_S$ on the small diameter side of the fatty acid metal salt particles more preferably satisfy the following Formula (32), and still more preferably satisfy the following Formula (33), from the viewpoint that the streak-shaped image defects due to a change in the posture of the cleaning blade are more inhibited.

$$1.0 \leq GSD_S/GSD_T \leq 2.0 \quad \text{Formula (32):}$$

$$1.25 \leq GSD_S/GSD_T \leq 1.8 \quad \text{Formula (33):}$$

—Relationship Between Volume Particle Diameter $D50_T$ of Toner Particles and Volume Particle Diameter $D50_E$ of Elastomer Particles, and Relationship Between Volume Particle Diameter $D50_T$ of Toner Particles and Volume Particle Diameter $D50_S$ of Fatty Acid Metal Salt Particles—

Furthermore, the volume particle diameter $D50_T$ of the toner particles and the volume particle diameter $D50_E$ of the elastomer particles preferably satisfy the following Formula (4). Further, the volume particle diameter $D50_T$ of the toner particles and the volume particle diameter $D50_S$ of the fatty acid metal salt particles preferably satisfy the following Formula (5).

$$0.8 \leq D50_E/D50_T \leq 2 \quad \text{Formula (4)}$$

$$0.16 \leq D50_S/D50_T \leq 3 \quad \text{Formula (5)}$$

Here, the significance of satisfying Formulae (4) and (5) will be described.

$D50_E/D50_T$ being in the above range means that it covers a range in which the volume particle diameter $D50_E$ of the elastomer particles is slightly smaller that the volume particle diameter $D50_T$ of the toner particles through a range up to a size twice the size of the volume particle diameter $D50_T$ of the toner particles. Further, $D50_S/D50_T$ being in the above range means that it covers a range in which the volume particle diameter $D50_S$ of the fatty acid metal salt particles is about ⅙ of the volume particle diameter $D50_T$ of the toner particles through a range up to a size three times the size of the volume particle diameter $D50_T$ of the toner particles.

For the elastomer particles and the fatty acid metal salt particles, if the volume particle diameter $D50_E$ and the volume particle diameter $D50_S$ are too larger than those of the toner particles, it is difficult that the elastomer particles and the fatty acid metal salt particles reach the edge portion of the cleaning unit, whereas if the volume particle diameter $D50_E$ and the volume particle diameter $D50_S$ are too small than those of the toner particles, it becomes difficult that they reach the external side with respect to the edge portion of the cleaning unit. Accordingly, by satisfying Formulae (4) and (5) as described above, it becomes easier that a pseudo lamination structure formed by alternate fatty acid metal salt-oil-fatty acid metal salt lamination is formed across the entire region of the toner dam from an edge of the cleaning unit to the external side. Thus, in the case where a low-intensity image is formed over a long period time and a high-intensity image is then formed, even when excess of the fatty acid metal salt particles and the oil are supplied to the non-image portion on the image holding member, excess of the fatty acid metal salt and the oil are further inhibited from being present in the non-image portion. As a result, it is considered that a change in the posture of the cleaning blade is further inhibited, and thus, streak-shaped image defects are inhibited.

Furthermore, from the viewpoint that the volume particle diameter $D50_T$ of the toner particles and the volume particle diameter $D50_E$ of the elastomer particles further inhibit the streak-shaped image defects due to a change in the posture of the cleaning blade, it is more preferable to satisfy the following Formula (42).

$$1.0 \leq D50_E/D50_T \leq 1.5 \quad \text{Formula (42):}$$

From the viewpoint that the volume particle diameter $D50_T$ of the toner particles and the volume particle diameter $D50_S$ of the fatty acid metal salt particles further inhibit the streak-shaped image defects due to a change in the posture of the cleaning blade, it is more preferable to satisfy the following Formula (52), and it is still more preferable to satisfy the following Formula (53).

$$0.18 \leq D50_S/D50_T \leq 2.0 \quad \text{Formula (52):}$$

$$0.20 \leq D50_S/D50_T \leq 1.0 \quad \text{Formula (53):}$$

(Elastomer Particles)

The elastomer particles in the second embodiment contain one or more kinds of oil. The material of the elastomer particles (the elastomer particles before incorporating an oil thereinto) is not limited as long as it has a property of being distorted by external force and restored from its distortion by the removal of the external force, and that is, the material is a so-called elastomer. Examples thereof include various known elastomers, and specifically, include synthetic rubber such as urethane rubber, silicone rubber, fluorine rubber, chloroprene rubber, butadiene rubber, ethylene-propylene-diene copolymerization rubber (EPDM), and epichlorohydrin rubber, and synthetic resins such as polyolefin, polystyrene, and polyvinyl chloride.

However, for the elastomer particles containing an oil, it is suitable to supply an oil to the elastomer particles when the elastomer particles are squeaked under a cleaning blade. As a result, the elastomer particles containing an oil are preferably porous elastomer particles containing an oil.

Since the porous elastomer particles (porous elastomer particles before incorporating an oil thereinto) include an oil, the particles may be particles having plural pores on at least the particle surface, and the specific surface area of the porous elastomer particles is preferably from 0.1 $m^2/g$ to 25 $m^2/g$, more preferably from 0.3 $m^2/g$ to 20 $m^2/g$, and still more preferably from 0.5 $m^2/g$ to 15 $m^2/g$. If it is within the range above, it is easy to impregnate an oil in the porous elastomer particles.

The specific surface area of the porous elastomer particles is measured by using a BET method.

Specifically, by using porous elastomer particles separated from a toner, 0.1 g of a sample to be measured is weighed by a device that measures a specific surface area and a pore distribution (SA3100, manufactured by Beckman Coulter, Inc.), put into a sample tube, and subjected to a degassing treatment and to automatic measurement by a multi-point method.

The oil contained in the elastomer particles may be any one which is a compound having a melting point of lower than 20° C., that is, a compound being liquid at 20° C., and examples thereof include various known silicone oils or lubricant oils. Further, the boiling point of the oil is preferably 150° C. or higher, and more preferably 200° C. or higher.

Furthermore, one kind or two or more kinds of the oils contained in the elastomer particles elastomer particle may be contained.

The oil is preferably a silicone oil.

Examples of the silicone oil include silicone oils such as dimethylpolysiloxane, diphenyl polysiloxane, and phenylmethylpolysiloxane, and reactive silicone oils such as amino-modified polysiloxane, epoxy-modified polysiloxane, carboxyl-modified polysiloxane, carbinol-modified polysiloxane, fluorine-modified polysiloxane, methacryl-modified polysiloxane, mercapto-modified polysiloxane, and phenol-modified polysiloxane. Among these, dimethylpolysiloxane (which is also called a "dimethylsilicone oil") is particularly preferable.

Furthermore, an oil having a polarity opposite to that of the adhesive particles (external additive) adhering to the surface of the toner particles may be used. Examples of the oil having a polarity opposite to that of the adhesive particles include positively chargeable oils such as a monoamine-modified silicone oil, a diamine-modified silicone oil, an amino-modified silicone oil, and an ammonium-modified silicone oil; and negatively chargeable oils such as a dimethylsilicone oil, an alkyl-modified silicone oil, an α-methylsulfone-modified silicone oil, a chlorophenylsilicone oil, and a fluorine-modified silicone oil.

The total content of oils in the elastomer particles is preferably from 0.01 mg to 100 mg, more preferably from 0.05 mg to 50 mg, and still more preferably from 0.1 mg to 30 mg, with respect to 1 g of the toner.

The total content of oils in the elastomer particles in the toner is measured by subjecting the elastomer particles to ultrasonic wave-washing (an output of 60 W, a frequency of 20 kHz, for 30 minutes) in hexane, filtering the washing liquid to remove the oil, which operation is repeated five times, and then vacuum-drying the residue at 60° C. for 12 hours. In addition, the oil content in the elastomer particles is calculated from the change in weights before and after the removal of an oil, and the total oil content with respect to 1 g of the toner is calculated from the amount of the elastomer particles to be added to the toner.

The content of the elastomer particles is preferably from 0.05 parts by mass to 5 parts by mass, more preferably from 0.1 parts by mass to 3 parts by mass, and still more preferably from 0.1 parts by mass to 2 parts by mass, with respect to 100 parts by mass of the toner particles.

For the elastomer particles, when the particle diameter at which the cumulative percentage drawn from the small diameter side becomes 50% is defined as a volume particle diameter $D50_E$ in the volume particle size distribution, the volume particle diameter $D50_E$ is preferably from 1 μm to 30 μm, and more preferably from 5 μm to 15 μm. By setting the volume particle diameter $D50_E$ in the above range, the streak-shaped image defects due to a change in the posture of the cleaning blade is more inhibited. Further, by setting the volume particle diameter $D50_E$ in the above range, the fluidity of the toner particles is secured and the amount of the oil supplied to the cleaning unit. Thus, the reduction of the image quality intensity when a high-intensity image is formed is inhibited, and the filming into an image holding member is inhibited.

—Volume Particle Size Distribution of Elastomer Particles—

From the viewpoint of satisfying Formula (1): $GSD_E/GSD_T \geq 1$, the volume particle size distribution index $GSD_E$ ($D50_E/D16_E$) of the drawn from the small diameter side of the elastomer particles is preferably from 1.2 to 2.0.

Examples of the method for controlling the volume particle diameter $D16_E$, the volume particle diameter $D50_E$, and the volume particle size distribution index $GSD_E$ ($D50_E/D16_E$) on the small diameter side of the toner particles to the ranges above include a method of adjusting the polymerization conditions (a temperature, time, an atmosphere, and the like) when elastomer particles are polymerized; and a method of adjusting elastomer particles by classification.

The volume particle diameter $D16_E$, the volume particle diameter $D50_E$, and the volume particle size distribution index $GSD_E$ ($D50_E/D16_E$) on the small diameter side of the elastomer particles are measured by the method as shown below.

100 primary particles of the elastomer particles are observed by a scanning electron microscope (SEM) device (S-4100, manufactured by Hitachi, Ltd.) to capture images, the images are inserted into an image analysis device (LUZEXIII, manufactured by NIRECO Corp.) to measure the longest diameter and the shortest diameter per particle by the image analysis of the primary particles, and thus, a circle-corresponding diameter is determined from the median value. A diameter (D16v) reaching 16% in the cumulative frequency of the obtained circle-corresponding diameters is defined as a volume particle diameter $D16_E$ of the elastomer particles, and a diameter (D50v) reaching 50% in the cumulative frequency of the obtained circle-corresponding diameters is defined as a volume particle diameter $D50_E$ of the elastomer particles. Further, the magnification of the electron microscope is adjusted to capture about 10 to 50 elastomer particles per field of view, and the visual observations conducted plural times are combined to determine the circle-corresponding diameter of the primary particles. Further, the volume particle size distribution index $GSD_E$ ($D50_E/D16_E$) on the small diameter side is calculated from the measured volume particle diameter $D16_E$ and the volume particle diameter $D50_E$.

—Method for Preparing Elastomer Particles (Elastomer Particles Before Incorporating Oil Thereinto)—

The method for preparing elastomer particles in the second embodiment is the same as the preparation method in the first embodiment.

—Method for Incorporating Oil into Elastomer Particles—

The method for incorporating an oil into the elastomer particles in the second embodiment is the same as the method in the first embodiment.

(Fatty Acid Metal Salt Particles)

The toner in the second embodiment has fatty acid metal salt particles. The fatty acid metal salt particles are particles formed of a salt of a fatty acid and a metal.

The fatty acid may be any of a saturated fatty acid and an unsaturated fatty acid, and a fatty acid having 10 to 25 carbon atoms are preferable. Examples of the saturated fatty acid include stearic acid, lauric acid, and behenic acid, stearic acid and lauric acid are more preferable, and stearic acid is still more preferable. Further, examples of the unsaturated fatty acid include oleic acid and linoleic acid. The metal is preferably a divalent metal, and examples of the metal include magnesium, calcium, aluminum, barium, and zinc, and zinc is suitable.

Examples of the fatty acid metal salt particles include particles of aluminum stearate, calcium stearate, potassium stearate, magnesium stearate, barium stearate, lithium stearate, zinc stearate, copper stearate, lead stearate, nickel stearate, strontium stearate, cobalt stearate, sodium stearate, zinc oleate, manganese oleate, iron oleate, aluminum oleate, copper oleate, magnesium oleate, calcium oleate, zinc palmitate, cobalt palmitate, copper palmitate, magnesium palmitate, aluminum palmitate, calcium palmitate, zinc laurate, manganese laurate, calcium laurate, iron laurate, magnesium laurate, aluminum laurate, zinc linoleate, cobalt linoleate, calcium linoleate, zinc ricinoleate, and aluminum ricinoleate, respectively.

Among these, fatty acid metal salt particles are more preferably particles of zinc stearate and zinc laurate, respectively, and still more preferably zinc stearate particles, from the viewpoint of inhibiting the streak-shaped image defects due to a change in the posture of the cleaning blade.

The content of the fatty acid metal salt particles is preferably from 0.02 parts by mass to 5 parts by mass, more preferably from 0.05 parts by mass to 3.0 parts by mass, and still more preferably from 0.08 parts by mass to 1.0 part by mass, with respect to 100 parts by mass of the toner particles.

However, the fatty acid metal salt particles may be mixed particles of plural kinds of fatty acid metal salts. Further, the fatty acid metal salt particles may be particles including components other than the fatty acid metal salt. Examples of the additional components include higher fatty acid alcohols, provided that the fatty acid metal salt particles include 10% by mass or more of fatty acid metal salts.

—Volume Particle Size Distribution of Fatty Acid Metal Salt Particles—

The volume particle diameter $D16_S$ of the fatty acid metal salt particles is preferably from 0.5 μm to 8 μm, more preferably from 1.0 μm to 7 μm, and still more preferably from 1.5 μm to 6 μm, from the viewpoint that the volume particle size distribution index $GSD_S$ ($D50_S/D16_S$) on the small diameter side is easily controlled to a specific range.

The volume particle diameter $D50_S$ of the fatty acid metal salt particles is preferably from 1 μm to 10 μm, more preferably from 1.5 μm to 9 μm, and more preferably from 2 μm to 8 μm, from the viewpoint that the volume particle size distribution index $GSD_S$ ($D50_S/D16_S$) on the small diameter side is easily controlled to a specific range.

The volume particle size distribution index $GSD_S$ ($D50_S/D16_S$) on the small diameter side of the fatty acid metal salt particles is preferably from 1.1 to 3.0, more preferably from 1.2 to 2.5, and still more preferably from 1.4 to 2.0, from the viewpoint of satisfying Formula (3): $GSD_S/GSD_T \geq 1$.

Examples of the method for controlling the volume particle diameter $D16_S$, the volume particle diameter $D50_S$, and the volume particle size distribution index $GSD_S$ ($D50_S/D16_S$) on the small diameter side to the above range include a method of controlling reaction conditions (a temperature, time, a pH, and the like) when fatty acid metal salt particles are prepared by cation substitution of fatty acid alkali metal salt particles; a method of controlling reaction conditions (a temperature, time, a pH, and the like) when fatty acid metal salt particles are prepared by the reaction of a fatty acid with metal hydroxide; and a method for adjusting the treatment conditions (pulverization conditions, classification conditions, and the like) of fatty acid metal salts obtained by the method above.

The volume particle diameter $D16_S$, the volume particle diameter $D50_S$, and the volume particle size distribution index $GSD_S$ ($D50_S/D16_S$) on the small diameter side of the fatty acid metal salt particles are measured by the method as shown below.

100 primary particles of the fatty acid metal salt particles are observed by a scanning electron microscope (SEM) device (S-4100, manufactured by Hitachi, Ltd.) to capture images, the images are inserted into an image analysis device (LUZEXIII, manufactured by NIRECO Corp.) to measure the longest diameter and the shortest diameter per particle by the image analysis of the primary particles, and thus, a circle-corresponding diameter is determined from the median value. A diameter (D16v) reaching 16% in the cumulative frequency of the obtained circle-corresponding diameters is defined as a volume average particle diameter $D16_S$ of the fatty acid metal salt particles, and a diameter (D50v) reaching 50% in the cumulative frequency of the obtained circle-corresponding diameters is defined as a volume average particle diameter $D50_S$ of the fatty acid metal salt particles. Further, the magnification of the electron microscope is adjusted to capture about 10 to 50 fatty acid metal salt particles per field of view, and the visual observations conducted plural times are combined to determine the circle-corresponding diameter of the primary particles. Further, the volume particle size distribution index $GSD_S$ ($D50_S/D16_S$) on the small diameter side is calculated from the measured volume particle diameter $D16_S$ and volume particle diameter $D50_S$.

Examples of the method for preparing a fatty acid metal salt include a method of subjecting a fatty acid alkali metal salt to cation substitution, and a method of directly reacting a fatty acid with metal hydroxide. Examples of the method for preparing zinc stearate include a method of subjecting sodium stearate to cation substitution, and a method of reacting stearic acid with zinc hydroxide.

—Mass Ratio of Elastomer Particles to Fatty Acid Metal Salt Particles—

The mass ratio of the elastomer particles to the fatty acid metal salt particles (elastomer particles/fatty acid metal salt particles) is preferably from 0.2 to 2.0, more preferably from 0.3 to 1.5, and still more preferably from 0.4 to 1.0, from the viewpoint of further inhibiting the streak-shaped image defects due to a change in the posture of the cleaning blade.

(Other External Additive)

The toner may include an external additive other than the elastomer particles and the fatty acid metal salt particles, which are externally added to the toner. Examples of such the additional external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

It is preferable that the surfaces of the inorganic particles as the external additive are subjected to a hydrophobization treatment. For example, the hydrophobization treatment is performed, by immersing the inorganic particles in a hydrophobization treatment agent. The hydrophobization treatment agent is not particularly limited and examples thereof include a silane-based coupling agent, silicone oil, a titanate-based coupling agent and an aluminum-based coupling agent. These may be used singly or in combination of two or more kinds thereof.

For example, the amount of the hydrophobization treatment agent is from 1 part by mass to 10 parts by mass with respect to 100 parts by mass of the inorganic particles.

Examples of the additional external additives also include resin particles (resin particles such as polystyrene, polymethyl methacrylate (PMMA), and a melamine resin), and cleaning activators (for example, a metal salt of higher fatty acid represented by zinc stearate and a particle of a fluorine-based polymer).

The amount of the additional external additive externally added is, for example, preferably from 0.01% by mass to 5% by mass, and more preferably from 0.01% by mass to 2.0% by mass, with respect to the toner particles.

(Method of Preparing Toner)

Next, a method for preparing the toner according to the present embodiment will be described.

The toner according to the first embodiment is obtained by preparing toner particles, and then externally adding an external additive and elastomer particles containing one or more kinds of oil to the toner particles.

The toner according to the second embodiment is obtained by preparing toner particles, and then externally adding an external additive, elastomer particles, and fatty acid metal salt particles to the toner particles.

The toner particles may be prepared, by any of a dry preparation method (for example, a kneading and pulverizing method) and a wet preparation method (for example, a fusion and coalescence method, a suspension polymerization method, and a dissolution suspension method). The method of preparing the toner particles is not limited thereto and a known method may be employed.

Among these, the toner particles are preferably obtained by a fusion and coalescence method.

Specifically, for example, in the case where the toner particles are prepared using the fusion and coalescence method, the toner particles are prepared through a step of preparing a resin particle dispersion in which resin particles which become a binder resin are dispersed (resin particle dispersion preparing step); a step of forming aggregated particles by aggregating the resin particles (if necessary, other particles) in the resin particle dispersions (if necessary, in the dispersion after other particle dispersion is mixed) (aggregated particle forming step); and a step of forming toner particles by heating the aggregated particle dispersion in which the aggregated particles are dispersed to fuse and coalesce the aggregated particles (fusion and coalescence step).

Hereafter, the details of the respective steps will be described.

Further, while a method for obtaining toner particles containing a colorant and a release agent will be described in the following description, the colorant and the release agent are used, if necessary. Additional additives other than the colorant and the release agent may, of course, be used.

—Resin Particle Dispersion Preparing Step—

First, along with a resin particle dispersion in which resin particles which will become a binder resin are dispersed, a colorant particle dispersion in which colorant particles are dispersed, and a release agent particle dispersion in which release agent particles are dispersed are prepared.

Here, the resin particle dispersion is prepared, for example, by dispersing resin particles in a dispersion medium by a surfactant.

An example of the dispersion medium used in the resin particle dispersion includes an aqueous medium.

Examples of the aqueous medium include water such as distilled water and ion-exchanged water, and alcohols and the like. These may be used singly or in combination of two or more kinds thereof.

Examples of the surfactant include anionic surfactants such as sulfuric ester salts, sulfonates, phosphoric esters and soap surfactants; cationic surfactants such as amine salts and quaternary ammonium salts; and nonionic surfactants such as polyethylene glycol, alkylphenol ethylene oxide adducts and polyols. Among these, particularly, anionic surfactants and cationic surfactants may be included. The nonionic surfactants may be used in combination with anionic surfactants or cationic surfactants.

The surfactants may be used singly or in combination of two or more kinds thereof.

Examples of the method for dispersing the resin particles in a dispersion medium for the resin particle dispersion include ordinary dispersing methods such as a method using a rotary shear type homogenizer, and a method using a ball mill, a sand mill, or a dynomill having media. In addition, the resin particles may be dispersed in a resin particle dispersion, for example, by a phase inversion emulsification method.

Incidentally, the phase inversion emulsification method is a method in which a resin to be dispersed is dissolved in a hydrophobic organic solvent capable of dissolving the resin, a base is added to the organic continuous phase (O phase) to neutralize the resin, an aqueous medium (W phase) is added to invert the resin into a discontinuous phase (so-caller inversed phase): from W/O to O/W, so that the resin may be dispersed in the form of particles in the aqueous medium.

The volume average particle diameter of the resin particles dispersed in the resin particle dispersions is preferably, for example, from 0.01 μm to 1 μm, more preferably from 0.08 μm to 0.8 μm, and still more preferably from 0.1 μm to 0.6 μm.

In addition, the volume average particle diameter of the resin particles is measured such that using the particle diameter distribution measured by a laser diffraction particle diameter distribution analyzer (for example, LA-700, manufactured by Horiba Seisakusho Co., Ltd.), a cumulative distribution is drawn from the small diameter side with respect to the volume based on the divided particle diameter ranges (channels) and the particle diameter at which the cumulative volume distribution reaches 50% of the total particle, particle volume is defined as a volume average particle diameter D50v. Further, the volume average particle diameter of particles in the other dispersion will be measured in the same manner.

For example, the content of the resin particles contained in the resin particle dispersion is preferably from 5% by mass to 50% by mass, and more preferably from 10% by mass to 40% by mass.

Moreover, for example, the colorant particle dispersion, and the release agent particle dispersion are prepared in a manner similar to the resin particle dispersion. That is, with respect to the volume average particle diameter of the particles, the dispersion medium, the dispersion method, and the content of the particles in the resin particle dispersion, the same is applied to the colorant particles dispersed in the colorant particle dispersion and the release agent particles dispersed in the release agent particle dispersion.

Aggregated Particle Forming Step

Next, the resin particle dispersion is mixed with the colorant particle dispersion, and the release agent particle dispersion.

Further, in the mixed dispersion, the resin particles, the colorant particles, and the release agent particle are hetero-aggregated to form aggregated particles containing the resin particles, the colorant particles, and the release agent particles, which have diameters close to the diameters of the desired toner particles.

Specifically, for example, an aggregation agent is added to the mixed dispersion, and the pH of the mixed dispersion is adjusted to be acidic (for example, a pH ranging from 2 to 5). As necessary, a dispersion stabilizer is added thereto, followed by heating to the glass transition temperature of the resin particles (specifically, from the temperature 30° C. lower than the glass transition temperature of the resin particles to the temperature 10° C. lower than the glass transition temperature). The particles dispersed in the mixed dispersion are aggregated to form aggregated particles.

In the aggregated particle forming step, for example, the aggregation agent is added to the mixed dispersion while stirring using a rotary shear type homogenizer at room temperature (for example, 25° C.), and the pH of the mixed dispersion is adjusted to be acidic (for example, a pH ranging from 2 to 5). As necessary, a dispersion stabilizer may be added thereto, followed by heating.

Examples of the aggregation agent include a surfactant having a polarity opposite to that of the surfactant used as the dispersant which is added to the mixed dispersion, an inorganic metal salt and a divalent or higher-valent metal complex. In particular, when a metal complex is used as an aggregation agent, the amount of the surfactant used is reduced, which results in improvement of charging properties.

An additive for forming a complex or a similar bond with a metal ion in the aggregation agent may be used, if necessary. As the additive, a chelating agent is suitably used.

Examples of the inorganic metal salt include metal salts such as calcium chloride, calcium nitrate, barium chloride, magnesium chloride, zinc chloride, aluminum chloride, and aluminum sulfate, and polymers of inorganic metal salts such as polyaluminum chloride, polyaluminum hydroxide, and calcium polysulfide.

As the chelating agent, a water-soluble chelating agent may be used. Examples of the chelating agent include oxycarboxylic acids such as tartaric acid, citric acid and gluconic acid, iminodiacetic acid (IDA), nitrilotriacetic acid (NTA), and ethylenediamine tetraacetic acid (EDTA).

The amount of the chelating agent added is preferably from 0.01 parts by mass to 5.0 parts by mass, and more preferably from 0.1 parts by mass or more and less than 3.0 parts by mass, with respect to 100 parts by mass of the resin particles.

—Fusion and Coalescence Step—

Next, the aggregated particles are fused and coalesced by heating the aggregated particle dispersion in which the aggregated particles are dispersed up to, for example, a temperature from the glass transition temperature of the resin particles (for example, 10° C. to 30° C. higher than the glass transition temperature of the resin particles) or higher, thereby forming toner particles.

The toner particles are obtained by the steps as described above.

Incidentally, the toner particles may also be prepared through a step in which after obtaining an aggregated particle dispersion in which the aggregated particles are dispersed, the aggregated particle dispersion is further mixed with a resin particle dispersion in which the resin particles are dispersed, and further aggregated to adhere the resin particles onto the surface of the aggregated particles, thereby forming, second aggregated particles; and a step in which a second aggregated particle dispersion in which the second aggregated particles are dispersed is heated to fuse and coalesce the second aggregated particles, thereby forming toner particles having a core-shell structure.

Here, after completion of the fusion and coalescence step, the dried toner particles are obtained by subjecting the toner particles formed in the solution to a washing step, a solid-liquid separation step, and a drying step, as known in the art.

The washing step may be preferably sufficiently performed by a replacement washing with ion-exchanged water in terms of charging properties. The solid-liquid separation step is not particularly limited but may be preferably performed by filtration under suction or pressure in terms of productivity. The drying step is not particularly limited but may be preferably performed by freeze-drying, flash jet drying, fluidized drying, or vibration fluidized drying in terms of productivity.

In addition, the toner according to the first embodiment is prepared by, for example, adding an external additive and elastomer particles containing one or more kinds of oil thereto to the obtained toner particles that have been dried, and mixing them.

In addition, the toner according to the second embodiment is prepared by, for example, adding an external additive, elastomer particles, and fatty acid metal salt particles to the obtained toner particles that have been dried, and mixing them.

The mixing is preferably carried out with, for example, a V-blender, a HENSCHEL MIXER, a Loedige mixer, or the like. Further, if necessary, coarse particles of the toner may be removed using a vibrating sieving machine, a wind power sieving machine, or the like.

<Electrostatic Charge Image Developer>

The electrostatic charge image developer according to the present embodiment is a developer including at least the toner according to the present embodiment.

The electrostatic charge image developer according to the present embodiment may be a single-component developer containing only the toner according to the present embodiment, or may be a two-component developer containing a mixture of the toner and a carrier.

There is no particular limitation to the carrier and examples of the carrier include known carriers. Examples of the carrier include a coated carrier in which the surface of a core material made of a magnetic powder is coated with a coating resin; a magnetic powder dispersed carrier in which a magnetic powder is dispersed and blended in a matrix resin; and a resin impregnated carrier in which magnetic powder is impregnated with a resin.

Incidentally, the magnetic powder dispersed carrier and the resin impregnated carrier may be carriers each having the constitutional particle of the carrier as a core and a coating resin coating the core.

Examples of the magnetic powder include magnetic metals such as iron, nickel, and cobalt; and magnetic oxides such as ferrate and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene acrylic acid copolymer, a straight silicone resin containing an organosiloxane bond or a modified article thereof, a fluoro resin, polyesters, polycarbonates, a phenol resin, and an epoxy resin.

Further, the coating resin and the matrix resin may contain other additives such as a conductive material.

Examples of the conductive particles include particles of metals such as gold, silver, and copper, carbon black, titanium oxide, zinc oxide, tin oxide, barium sulfate, aluminum borate, potassium titanate, and the like.

Here, in order to coat the surface of the core material with the coating resin, a coating method using a coating resin and a coating layer forming solution in which various kinds of additives, if necessary, are dissolved in an appropriate solvent may be used. The solvent is not particularly limited and may be selected depending on a coating resin to be used, application suitability, or the like.

Specific examples of the resin coating method include an dipping method of dipping a core material in a coating layer forming solution, a spray method of spraying a coating layer forming solution to the surface of a core material, a fluidized-bed method of spraying a coating layer forming solution to a core material while the core material is suspended by a fluidizing air, and a kneader coater method of mixing a core material of a carrier with a coating layer forming solution in a kneader coater, and then removing the solvent.

In the two-component developer, a mixing ratio (mass ratio) of the toner and the carrier is preferably toner: carrier=1:100 to 30:100, and more preferably 3:100 to 20:100.

<Image Forming Apparatus and Image Forming Method>

The image forming apparatus and the image forming method according to the present embodiment will be described.

The image forming apparatus according to the present embodiment includes an image holding member; charging means for charging the surface of the image holding member; electrostatic charge image forming means for forming an electrostatic charge image on the surface of the charged image holding member; developing means for accommodating an electrostatic charge image developer, and developing the electrostatic charge image formed on the surface of the image holding member as a toner image by the electrostatic charge image developer; transfer means for transferring the toner image formed on the surface of the image holding member onto the surface of a recording medium; cleaning means having a cleaning blade for cleaning the surface of the image holding member; and fixing means for fixing the toner image transferred onto the surface of the recording medium. Further, as the electrostatic charge image developer, the electrostatic charge image developer according to the present embodiment is applied.

In the image forming apparatus according to the present embodiment, an image forming method (an image forming method according to the present embodiment) including a charging step of charging the surface of an image holding member; an electrostatic charge image forming step of forming an electrostatic charge image on the surface of the charged image holding member; a developing step of developing the electrostatic charge image formed on the surface of the image holding member as a toner image using the electrostatic charge image developer according to the present embodiment; a transfer step of transferring the toner image formed on the surface of the image holding member onto the surface of a recording medium; a cleaning step of cleaning the surface of the image holding member using a cleaning blade; and a fixing step of fixing the toner image transferred onto the surface of the recording medium is carried out.

As the image forming apparatus according to the present embodiment, known image forming apparatuses such as a direct transfer type apparatus which directly transfers a toner image formed on the surface of an image holding member onto a recording medium; an intermediate transfer type apparatus which primarily transfers a toner image formed on the surface of an image holding member onto the surface of an intermediate transfer member and secondarily transfers the toner image transferred on the surface of the intermediate transfer member onto the surface of a recording medium; an apparatus including cleaning means for cleaning the surface of an image holding member before charged and after a toner image is transferred; and an apparatus including charge erasing means for erasing a charge from the surface of an image holding member before charged and after a toner image is transferred by irradiating the surface with charge erasing light is applied.

In the case of the intermediate transfer type apparatus, for example, a configuration in which transfer means includes an intermediate transfer member in which a toner image is transferred onto the surface, primary transfer means which primarily transfers the toner image formed on the surface of the image holding member onto the surface of the intermediate transfer member, and secondary transfer means which secondarily transfers the toner image transferred onto the surface of the intermediate transfer member onto the surface of a recording medium is applied.

Incidentally, in the image forming apparatus according to the present embodiment, for example, a portion including the developing means may have a cartridge structure (process cartridge) which is detachable from the image forming apparatus. As the process cartridge, for example, a process cartridge provided with developing means for accommodating the electrostatic charge image developer according to the present embodiment is suitably used.

Hereafter, an example of the image forming apparatus according to the present embodiment will be described, but the invention is not limited thereto. Further, main components shown in the drawing will be described, and the descriptions of the other components will be omitted.

FIG. 1 is a schematic configuration diagram showing an example of an image forming apparatus according the present embodiment.

The image forming apparatus shown in FIG. 1 includes first to fourth electrophotographic image forming units 10Y, 10M, 10C, and 10K (image forming means) which output images of the respective colors including yellow (Y), magenta (M), cyan (C), and black (K) on the basis of color-separated image data. These image forming units (hereinafter, also referred to simply as "units" in some cases) 10Y, 10M, 10C, and 10K are arranged horizontally with predetermined distances therebetween. Further, these units 10Y, 10M, 10C, and 10K may be each a process cartridge which is attachable to or detachable from the image forming apparatus.

An intermediate transfer belt 20 is provided through each unit as an intermediate transfer member extending above each of the units 10Y, 10M, 10C, and 10K in the drawing. The intermediate transfer belt 20 is wound around a drive roller 22 and a support roller 24 coming into contact with the inner surface of the intermediate transfer belt 20, which are separated from each other from left to right in the drawing. The intermediate transfer belt 20 travels in a direction from the first unit 10Y to the fourth unit 10K. Incidentally, the support roller 24 is pushed in a direction moving away from the drive roller 22 by a spring or the like which is not shown, such that tension is applied to the intermediate transfer belt 20 which is wound around the support roller 24 and the drive roller 22. Further, on the surface of the image holding member side of the intermediate transfer belt 20, an intermediate transfer member cleaning is provided opposing the drive roller 22.

In addition, toners in the four colors of yellow, magenta, cyan and black, which are accommodated in toner cartridges 8Y, 8M, 8C, and 8K, respectively, are supplied to developing devices (developing means) 4Y, 4M, 4C, and 4K of the units 10Y, 10M, 10C, and 10K, respectively.

Since the first to fourth units 10Y, 10M, 10C, and 10K have the same configuration, the first unit 10Y, which is provided on the upstream side in the travelling direction of the intermediate transfer belt and forms a yellow image, will be described as a representative example. Further, the same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y includes a photoreceptor 1Y functioning as the image holding member. In the surroundings of the photoreceptor 1Y, there are successively disposed a charging roller (an example of the charging means) 2Y that charges the surface of the photoreceptor 1Y to a predetermined potential; an exposure device (an example of the electrostatic charge image forming means) 3 that exposes the charged surface with a laser beam 3Y on the basis of a color-separated image signal to form an electrostatic charge image; the developing device (an example of the developing means) 4Y that supplies a charged toner into the electrostatic charge image to develop the electrostatic charge image; a primary transfer roller (an example of the primary transfer means) 5Y that transfers the developed toner image onto the intermediate transfer belt 20; and a photoreceptor cleaning device (an example of the cleaning means) 6Y having a cleaning blade 6Y-1 that removes the toner remaining on the surface of the photoreceptor 1Y after the primary transfer.

Incidentally, the primary transfer roller 5Y is disposed inside the intermediate transfer belt 20 and provided in the position facing the photoreceptor 1Y. Further, bias power supplies (not shown), which apply primary transfer biases, are respectively connected to the respective primary transfer rollers 5Y, 5M, 5C, and 5K. A controller not shown controls the respective bias power supplies to change the transfer bias which are applied to the respective primary transfer rollers.

Hereafter, the operation of forming a yellow image in the first unit 10Y will be described.

First, before the operation, the surface of the photoreceptor 1Y is charged at a potential of −600 V to −800 V by the charging roller 2Y.

The photoreceptor 1Y is formed by stacking a photosensitive layer on a conductive substrate (volumetric resistivity at 20° C.: $1\times10^{-6}$ Ωcm or lower). In general, this photosensitive layer has high resistance (resistance similar to that of general resin), and has properties in which, when irradiated with the laser beam 3Y, the specific resistance of a portion irradiated with the laser beam changes. Therefore, the laser beam 3Y is output to the charged surface of the photoreceptor 1Y through the exposure device 3 in accordance with yellow image data sent from the controller not shown. The photosensitive layer on the surface of the photoreceptor 1Y is irradiated with laser beam 3Y, and as a result, an electrostatic charge image having a yellow image pattern is formed on the surface of the photoreceptor 1Y.

The electrostatic charge image is an image which is formed on the surface of the photoreceptor 1Y by charging and is a so-called negative latent image which is formed when the specific resistance of a portion, which is irradiated with the laser beam 3Y, of the photosensitive layer is reduced and the charged charge flows on the surface of the photoreceptor 1Y and, in contrast, when the charge remains in a portion which is not irradiated with the laser beam 3Y.

The electrostatic charge image which is thus formed on the photoreceptor 1Y is rotated to a predetermined development position along with the travel, of the photoreceptor 1Y. At this development position, the electrostatic charge image on the photoreceptor 1Y is visualized (to a developed image) as a toner image by the developing device 4Y.

The developing device 4Y accommodates, for example, the electrostatic charge image developer, which contains at least a yellow toner and a carrier. The yellow toner is frictionally charged by being stirred in the developing device 4Y to have a charge with the same polarity (negative polarity) as that of a charge charged on the photoreceptor 1Y and is maintained on a developer roller (as an example of the developer holding member). Further, when the surface of the photoreceptor 1Y passes through the developing device 4Y, the yellow toner is electrostatically attached to a latent image portion at which the charge is erased from the surface of the photoreceptor 1Y, and the latent image is developed with the yellow toner. The photoreceptor 1Y on which a yellow toner image is formed subsequently travels at a predetermined rate, and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y, an electrostatic force directed from the photoreceptor 1Y toward the primary transfer roller 5Y acts upon the toner image, and the toner image on the photoreceptor 1Y is transferred onto the intermediate transfer belt 20. The transfer bias applied at this time has a polarity opposite (+) to the polarity (−) of the toner, and for example, the first unit 10Y is controlled to +10 μA to according to the control portion (not shown).

On the other hand, the toner remaining on the photoreceptor 1Y is removed and collected by the cleaning blade 6Y-1 of the photoreceptor cleaning device 6Y.

Also, primary transfer biases to be applied respectively to the primary transfer rollers 5M, 5C, and 5K at the second unit 10M and subsequent units, are controlled similarly to the primary transfer bias of the first unit.

In this manner, the intermediate transfer belt 20 having a yellow toner image transferred thereonto from the first unit 10Y is sequentially transported through the second to fourth units 10M, 10C, and 10K, and toner images of respective colors are superimposed and multi-transferred.

The intermediate transfer belt 20 having the four-color toner images multi-transferred thereonto through the first to fourth units arrives at a secondary transfer portion which is configured with the intermediate transfer belt 20, the support roller 24 coming into contact with the inner surface of the intermediate transfer belt and a secondary transfer roller 26 (an example of the secondary transfer means) disposed on the side of the image holding surface of the intermediate transfer belt 20. Meanwhile, a recording paper P (an example of the recording medium) is supplied to a gap at which the secondary transfer roller 26 and the intermediate transfer belt 20 are brought into contact with each other at a predetermined timing through a supply mechanism and a secondary transfer bias is applied to the support roller 24. The transfer bias applied at this time has the same polarity (−) as the polarity (−) of the toner, and an electrostatic force directing from the intermediate transfer belt 20 toward the recording paper P acts upon the toner image, whereby the toner image on the intermediate transfer belt 20 is transferred onto the recording paper P. Incidentally, on this occasion, the secondary transfer bias is determined depending upon a resistance detected by resistance detecting means (not shown) for detecting a resistance of the secondary transfer portion, and the voltage is controlled.

Thereafter, the recording paper P is sent to a press contact portion (nip portion) of a pair of fixing rollers in a fixing device 28 (an example of the fixing means), and the toner image is fixed onto the recording paper P to form a fixed image.

Examples of the recording paper P onto which the toner image is transferred include plain paper used for electrophotographic copying machines, printers and the like. As the recording medium, other than the recording paper P, OHP sheets may be used.

In order to improve the smoothness of the image surface after the fixing, the surface of the recording paper P is preferably smooth, for example, coated paper in which the surface of plain paper is coated with a resin and the like, art paper for printing, and the like are suitably used.

The recording paper P in which fixing of a color image is completed is transported to an ejection portion, whereby a series of the color image formation operations end.

<Process Cartridge and Toner Cartridge>

A process cartridge according to the present embodiment will be described.

The process cartridge according to the present embodiment is a process cartridge which includes developing means for accommodating the electrostatic charge image developer according to the present embodiment, and developing an electrostatic charge image formed on the surface of an image holding member as a toner image using the electrostatic charge image developer, and is attachable to or detachable from an image forming apparatus.

The process cartridge may include a developer holding member for holding and supplying the electrostatic charge image developer and a container that accommodates the electrostatic charge image developer.

Moreover, the configuration of the process cartridge according to the present embodiment is not limited thereto and may include a developing device and, additionally, at least one selected from other means such as an image holding member, charging means, electrostatic charge image forming means, and transfer means, if necessary.

Hereafter, an example of the process cartridge according to the present embodiment will be shown and the process cartridge is not limited, thereto. Main components shown in the drawing will be described, and the descriptions of the other components will be omitted.

Figure 2:
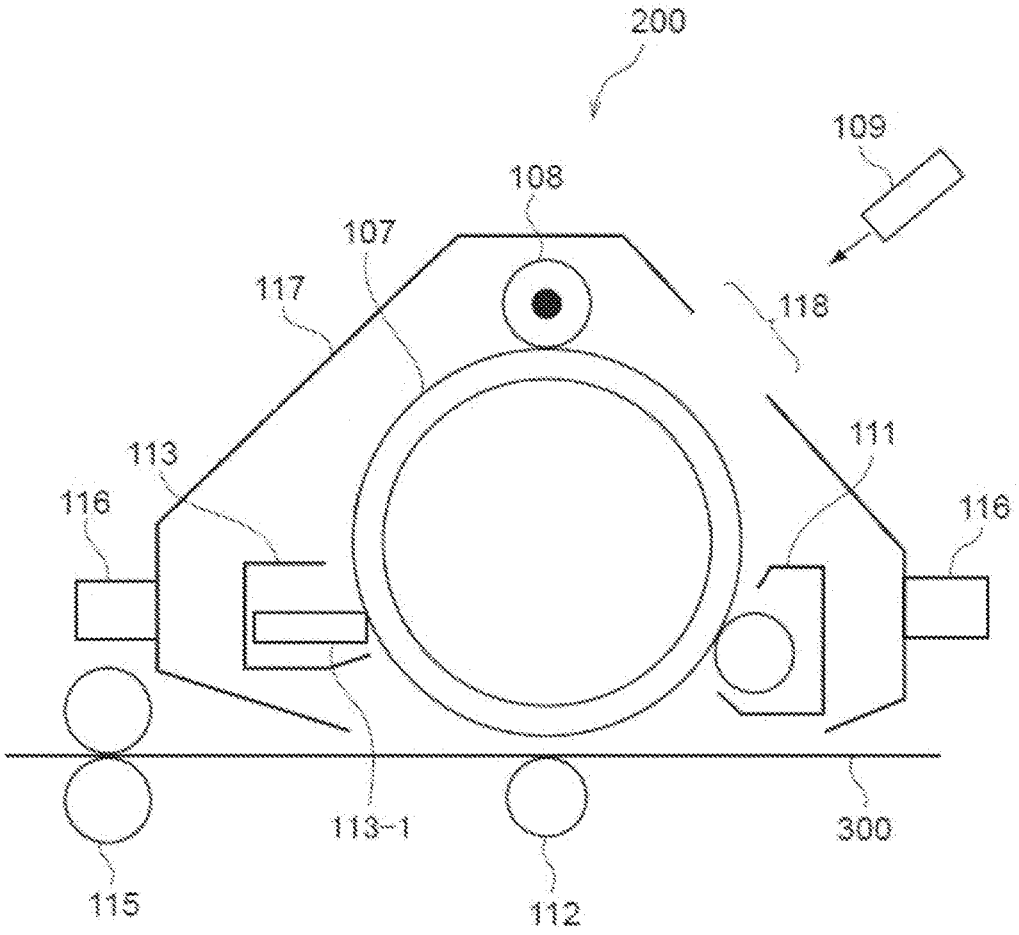
FIG. 2 is a schematic configuration diagram showing an example of a process cartridge according the present embodiment.

FIG. 2 is a schematic configuration diagram showing a process cartridge according the present embodiment.

A process cartridge 200 shown in FIG. 2 includes, a photoreceptor 107 (an example of the image holding member), a charging roller 108 (an example of the charging means), a developing device 111 (an example of the developing means) and a photoreceptor cleaning device 113 (an example of the cleaning means) including a cleaning blade 113-1, provided in the periphery of the photoreceptor 107, all of which are integrally combined and supported, for example, by a housing 117 provided with a mounting rail 116 and an opening portion 118 for exposure to form a cartridge.

Further, in FIG. 2, 109 denotes an exposure device (an example of the electrostatic charge image forming means), 112 denotes a transfer device (an example of the transfer means), 115 denotes a fixing device (an example of the fixing means), and 300 denotes recording paper (an example of the recording medium).

Next, the toner cartridge according to the present embodiment will be described.

The toner cartridge according to the present embodiment is a toner cartridge which accommodates the toner according to the present embodiment, and is attachable to or detachable from an image forming apparatus. The toner cartridge accommodates the toner for replenishment in order to supply the toner to the developing means provided in the image forming apparatus.

Moreover, the image forming apparatus shown in FIG. 1 is an image forming apparatus having a configuration in which the toner cartridges 8Y, 8M, 8C, and 8K are detachably attached, and the developing devices 4Y, 4M, 4C, and 4K are connected to toner cartridges corresponding to the respective developing devices (colors) via a toner supply line not shown. Further, in the case where the toner accommodated in the toner cartridge runs low, the toner cartridge is replaced.

EXAMPLES

Hereafter, the present embodiments are more specifically described with reference to Examples and Comparative Examples, but the present embodiments are not limited to these Examples. Further, unless otherwise specified, "part(s)" and "%" represent "part(s) by mass" and "% by mass", respectively.

[Production of Elastomer Particles A to F]

100 parts of methyl vinyl polysiloxane and 10 parts of methyl hydrogen siloxane are mixed, and 30 parts of calcium carbonate powder (number average particle diameter: 0.1 μm, TP-123 manufacture by OKUTAMA Kogyo Co., Ltd.), 1 part of polyoxyethyleneoctylphenylether, and 200 parts of water are added to the mixture, followed by performing emulsification by a mixer at 6,000 rpm for 3 minutes. Then, 0.001 parts of a chloroplatinic acid-olefin complex in terms of the amount of platinum is added to the mixture, followed by performing a polymerization reaction at 80° C. for 10 hours in a nitrogen atmosphere. Thereafter, hydrochloric acid is put into the mixture to decompose calcium carbonate, and then water-washing is carried out. In addition, wet classification is performed to screen desired elastomer particles having a volume particle diameter $D16_T$ and a volume particle diameter $D50_T$, and perform vacuum-drying at 100° C. for 12 hours.

Thereafter, 150 parts of a dimethylsilicone oil is dissolved in 1000 parts of ethanol, and mixed with 100 parts of elastomer particles under stirring, and then ethanol as a solvent is evaporated using an evaporator, and dried to obtain oil-treated elastomer particles A to F.

The oil-treated elastomer particles A to F are observed by the method as described above, and the volume particle diameter $D16_T$ and the volume particle diameter $D50_T$ are measured by the method as described above. The measurement results are shown in Tables 1 and 2.

[Preparation of Polyester Resin Dispersion (1)]

45 parts by mole of 1,9-nonanediol, 55 parts by mole of dodecanedicarboxylic acid, and 0.05 parts by mole of dibutyltin oxide as a catalyst are put into a 3-neck flask that has been dried by heating, the air in the flask is made an inert atmosphere by a nitrogen gas by a pressure reduction operation, and the mixture is stirred and refluxed by mechanic stirring at 180° C. for 2 hours. Thereafter, the mixture is slowly warmed to 230° C. under reduced pressure and stirred for 5 hours, and when the mixture became viscous, it is cooled in air, and the reaction is stopped to synthesize a polyester resin. The weight average molecular weight (Mw) of the obtained polyester resin is measured by gel permeation chromatography (in terms of polystyrene) and is found to be 25,000. Thereafter, 3,000 parts of the obtained polyester resin, 10,000 parts of ion-exchanged water, and 90 parts of sodium dodecylbenzenesulfonate as a surfactant are put into an emulsification tank of a high temperature/high pressure emulsifier (CAVITRON CD1010, slit: 0.4 mm), and then the mixture is heated and melted at 130° C., dispersed for 30 minutes at 10,000 rotations at a flow rate of 3 L/m at 110° C., and passed through a cooling tank to recover a crystalline polyester resin dispersion (high temperature/high pressure emulsifier (CAVITRON CD1010, slit: 0.4 mm, manufactured by CAVITRON), thereby obtaining a polyester resin dispersion (1).

[Preparation of Polyester Resin Dispersion (2)]

15 parts by mole of polyoxyethylene(2,0)-2,2-bis(4-hydroxyphenyl)propane, 85 parts by mole of polyoxypropylene(2,2)-2,2-bis(4-hydroxyphenyl)propane, 10 parts by mole of terephthalic acid, 67 parts by mole of fumaric acid, 3 parts by mole of n-dodecenylsuccinic acid, 20 parts by mole of trimellitic acid, and 0.05 parts by mole of dibutyltin oxide with respect to these acid components (total moles of terephthalic acid, n-dodecenylsuccinic acid, trimellitic acid, and fumaric acid) are put into a container, warmed while maintaining it under an inert atmosphere with introduction of a nitrogen gas into the container, and then subjected to a copolycondensation reaction at 150° C. to 230° C. for 12 hours to 20 hours. Thereafter, the mixture is slowly subjected to pressure reduction at 210° C. to 250° C., thereby synthesizing a polyester resin. The weight average molecular weight Mw of this resin is 65,000. Thereafter, 3,000 parts of the obtained polyester resin, 10,000 parts of ion-exchanged water, and 90 parts of sodium dodecylbenzenesulfonate as a surfactant are put into an emulsification tank of a high temperature/high pressure emulsifier (CAVITRON CD1010, slit: 0.4 mm), and then the mixture is heated and melted at 130° C., dispersed for 30 minutes at 10,000 rotations at a flow rate of 3 L/m at 110° C., and passed through a cooling tank to recover a polyester resin dispersion (high temperature/high pressure emulsifier (CAVITRON CD1010, slit: 0.4 mm, manufactured by CAVITRON), thereby obtaining a polyester resin dispersion (2).

[Preparation of Colorant Dispersion]

Cyan pigment (copper phthalocyanine, C. I. Pigment Blue 15:3, manufactured by Dainichiseika Color & Chemicals Mfg. Co., Ltd.): 1,000 parts Ionic surfactant NEOGEN RK (manufactured by Dai-Ichi Kogyo Seiyaku Co., Ltd.): 150 parts Ion-exchanged water: 4,000 parts The blending liquid above is mixed and dissolved, and dispersed for 1 hour using a high pressure counter collision type dispersing machine ULTIMAIZER (HJP30006, manufactured by Sugino Machine Ltd.), thereby obtaining a colorant dispersion having a volume average particle diameter of 180 nm and a solid content of 20%.

[Preparation of Release Agent Dispersion]

Paraffin wax HNP9 (melting temperature of 75° C., manufactured by NIPPON SEIRO Co., Ltd.): 46 parts Cationic surfactant, NEOGEN RK (manufactured by Dai-Ichi Kogyo Seiyaku Co., Ltd.): 5 parts Ion-exchanged water: 200 parts The components above are heated to 100° C., sufficiently dispersed using ULTRATRAX T50 manufactured by IKA Japan K. K., and then subjected to a dispersion treatment using a pressure discharge type GAOLIN homogenizer, thereby obtaining a releasing agent dispersion having a volume average particle diameter of 200 nm and a solid content of 20.0%.

[Production of Toner Particles a]

Polyester resin dispersion (1): 33.2 parts

Polyester resin dispersion (2): 256.8 parts

Colorant dispersion: 27.4 parts

Release agent dispersion: 35 parts

The components above are put into a round-bottom stainless steel flask, and sufficiently mixed and dispersed using ULTRATRAX T50. Then, 0.20 parts of polyaluminum chloride is added thereto, the dispersion operation using ULTRATRAX T50 is continued. The flask is heated to 48° C. while being stirred in an oil bath for heating. After holding at 48° C. for 60 minutes, 70.0 parts of the polyester resin dispersion (2) is added to the flask. Thereafter, the pH in the system is adjusted to 8.0 using an aqueous sodium hydroxide solution having a concentration of 0.5 mol/L. Then, the stainless-steel flask is sealed and heated to 96° C. while being continuously stirred with a seal using magnetic force, followed by holding for 3 hours. After the reaction ended, the mixture is cooled, filtered, and sufficiently ished with ion-exchanged water. Then, solid-liquid separation is performed through Nutsche-type suction filtration. The obtained material is further redispersed using 1,000 parts of ion-exchanged water at 30° C., and stirred and washed at 300 rpm for 15 minutes. This operation is further repeated five times, and when the filtrate had a pH of 7.5 and an electrical conductivity of 7.0 μS/cm, solid-liquid separation is performed through Nutsche-type suction filtration using No. 5A filter paper. Next, vacuum drying is continued for 12 hours, thereby obtaining toner particles a. The obtained toner particles a are observed by the method as described above, and the volume particle diameter $D16_T$, the volume particle diameter $D50_T$, and the volume particle size distribution index $GSD_T$ ($D50_T/D16_T$) on the small diameter side are measured. Further, toner particles b to e obtained by the methods as described below are observed by the same method, and the volume particle diameter $D16_T$, the volume particle diameter $D50_T$, and the volume particle size distribution index $GSD_T$ ($D50_T/D16_T$) on the small diameter side are measured by the same method. The measurement results are shown in Tables 1 and 2.

[Production of Toner Particles b, c, d, e, f, g, and h]

In the same manner as for the production of the toner particles a, except that the aggregation time (a time for which the flask is heated to 48° C. while stirring in an oil bath for heating, and maintained at 48° C.) is changed in the production of the toner particles a, toner particles b to h, each having adjusted $D50_T$, $D16_T$, and $GSD_T$, are obtained.

[Production of External Additive (Silica Particles)]

150 parts of 25% aqueous ammonia is added dropwise to 150 parts of tetramethoxysilane at 30° C. over 5 hours in the presence of 100 parts of ion-exchanged water and 100 parts of 25% alcohol, and the mixture is stirred at 280 rpm. The silica sol suspension obtained by the reaction is centrifuged, and separated into wet silica gel, an alcohol, and aqueous ammonia, and the wet silica gel thus additionally separated is dried at 120° C. for 2 hours. Then, 100 parts of silica and 500 parts of ethanol are put into an evaporator, and the mixture is stirred for 15 minutes while maintaining the temperature at 40° C. Next, 10 parts of dimethyldimethoxysilane is added to 100 parts of silica and the mixture is further stirred for 15 minutes. Lastly, the temperature is raised to 90° C., ethanol is dried off under reduced pressure, and the treated product is collected and further vacuum-dried at 120° C. for 30 minutes. The dried silica is pulverized to obtain silica particles having a number average particle diameter of 140 nm.

Examples 1 to 8, and Comparative Examples 1 to 3

(Production of Toner)

The elastomer particle species, the toner particle species, and the silica particles shown in Tables 1 and 2 are combined to produce toners of Examples 1 to 8, and Comparative Examples 1 to 3 shown in Tables 1 and 2. Specifically, 0.5 parts of the elastomer particles and 3.6 parts of the silica particle with respect to 100 parts of the toner particles are mixed at 3,600 rpm for 10 minutes in a HENSCHEL MIXER to produce toners.

Furthermore, for the elastomer particles A to F, the total content of the oil with respect to 1 g of the toner is calculated by the method as described above, and is found to be all 15 mg.

(Production of Carrier)

Ferrite particles (average particle diameter of 50 μm, volume electric resistance of $3\times10^8$ Ω·cm): 100 parts Toluene: 14 parts Perfluorooctylethyl acrylate/dimethylaminoethyl methacrylate copolymer (copolymerization ratio of 90:10, Mw=50,000): 1.6 parts Carbon black (VXC-72, manufactured by Cabot Corporation): 0.12 parts The components except for ferrite particles among the components described above are dispersed for 10 minutes by a stirrer to prepare a coating film forming solution. This coating film forming solution and the ferrite particles are placed in a vacuum-deaeration kneader, and stirred at 60° C. for 30 minutes. Toluene is removed under reduced pressure, and a resin film is formed on the surface of the ferrite particles, thereby preparing a carrier. Further, the volume average particle diameter of the obtained carrier is 51 μm.

(Production of Developer)

The toner and the carrier as obtained above are put into a V-blender at a mass ratio of 5:95 and stirred for 20 minutes, thereby obtaining developers of Examples 1 to 8, and Comparative Examples 1 to 3.

The obtained developer is charged in DocuCentre Color 400 (manufactured by Fuji Xerox Co., Ltd.) and evaluated as follows. The evaluation results of the respective Examples and Comparative Examples are shown in Tables 1 and 2.

[Evaluation of Image Failure]

(Evaluation of Color Streaks)

An image having an image area ratio of 50% is continuously output on 500,000 sheets of A4 paper in a low-humidity environment (15° C. and 15% RH) in DocuCentre Color 400 manufactured by Fuji Xerox Co., Ltd., including the obtained developer. The color streaks are evaluated with respect to the image quality of an image on every $500^{th}$ sheet when 500,000 sheets are continuously output, and the occurrence of color streaks is visually evaluated. The evaluation criteria are as follows, provided that the acceptable evaluation results are from G1.0 to G5.0.

—Evaluation Criteria for Color Streaks—

G1.0: Number of sheets having occurrence of color streaks≤1 sheet

G2.0: 1 sheet<Number of sheets having occurrence of color streaks≤3 sheets

G3.0: 3 sheets<Number of sheets having occurrence of color streaks≤5 sheets

G4.0: 5 sheets<Number of sheets having occurrence of color streaks≤10 sheets

G5.0: 10 sheets<Number of sheets having occurrence of color streaks≤15 sheets

G6.0: 15 sheets<Number of sheets having occurrence of color streaks≤20 sheets

G7.0: 20 sheets<Number of sheets having occurrence of color streaks≤25 sheets

TABLE 1

| | Elastomer particles | | | | Toner particles | | | | | | Evaluation |
|---|---|---|---|---|---|---|---|---|---|---|---|
| | Type | $D50_E$ (μm) | $D16_E$ (μm) | $GSD_E$ | Type | $D50_T$ (μm) | $D16_T$ (μm) | $GSD_T$ | $GSD_E/GSD_T$ | $D50_E/D50_T$ | of color streaks |
| Example 1 | A | 5.3 | 3.8 | 1.41 | a | 4.0 | 3.31 | 1.21 | 1.17 | 1.33 | G1.0 |
| Example 2 | B | 5.1 | 3.9 | 1.32 | b | 4.2 | 3.50 | 1.20 | 1.10 | 1.21 | G2.0 |
| Example 3 | C | 7.1 | 6.1 | 1.30 | a | 4.0 | 3.31 | 1.21 | 1.07 | 1.97 | G3.5 |
| Example 4 | D | 3.5 | 2.7 | 1.36 | c | 4.2 | 3.47 | 1.21 | 1.07 | 0.83 | G3.5 |
| Example 5 | A | 5.3 | 2.0 | 1.41 | d | 4.5 | 3.72 | 1.21 | 1.17 | 0.62 | G5.0 |
| Example 6 | E | 8.1 | 5.7 | 1.12 | a | 4.0 | 3.31 | 1.21 | 1.18 | 2.03 | G4.0 |
| Example 7 | F | 8.0 | 3.6 | 2.22 | d | 4.5 | 3.72 | 1.21 | 1.83 | 1.78 | G1.5 |
| Example 8 | G | 13.4 | 9.3 | 1.44 | e | 6.8 | 5.6 | 1.21 | 1.18 | 1.97 | G2.5 |

TABLE 2

| | Elastomer particles | | | | Toner particles | | | | | | Evaluation of |
|---|---|---|---|---|---|---|---|---|---|---|---|
| | Type | $D50_E$ (μm) | $D16_E$ (μm) | $GSD_E$ | Type | $D50_T$ (μm) | $D16_T$ (μm) | $GSD_T$ | $GSD_E/GSD_T$ | $D50_E/D50_T$ | color streaks Type |
| Comparative Example 1 | H | 5.2 | 4.6 | 1.14 | f | 4.1 | 3.4 | 1.20 | 0.95 | 1.27 | G5.5 |
| Comparative Example 2 | I | 5.0 | 4.5 | 1.11 | g | 8.5 | 5.0 | 1.30 | 0.85 | 0.77 | G7.0 |
| Comparative Example 3 | J | 12 | 11.0 | 1.09 | h | 5.8 | 4.83 | 1.20 | 0.91 | 2.07 | G6.0 |

From the evaluation results, it could be seen that in Examples 1 to 8, the occurrence of color streaks due to cleaning failure is inhibited, as compared with Comparative Examples 1 to 3.

Furthermore, it could be seen that in Examples 1 to 4, 7, and 8 in which the volume particle diameter $D50_E$ of the elastomer particles and the volume particle diameter $D50_T$ of the toner particles satisfy $0.8 \leq D50_E/D50_T \leq 2$, the occurrence of color streaks due to cleaning failure is further inhibited, as compared with Example 5 with $D50_E/D50_T < 0.8$, and Example 6 with $D50_E/D50_T > 2$.

From the above description, it could be seen that when the toner includes elastomer particles containing an oil, and the volume particle size distribution index on the small diameter side of the elastomer particles and the volume particle size distribution index on the small diameter side of the toner particles satisfy $GSD_E/GSD_T \geq 1$, a toner for developing an electrostatic charge image, in which cleaning failure occurring at a time of forming an image is inhibited, is obtained.

[Production of Elastomer Particles a to f]

100 parts of methylvinyl polysiloxane and 10 parts of methylhydrogen siloxane are mixed, and 30 parts of calcium carbonate powder (number average particle diameter: 0.1 μm, TP-123 manufactured by OKUTAMA Kogyo Co., Ltd.), 1 part of polyoxyethyleneoctylphenylether, and 200 parts of water are added to the mixture. The mixture is subjected to emulsification at 6,000 rpm for 3 minutes using a mixer, and then, 0.001 parts of a chloroplatinic acid-olefin complex in terms of the amount of platinum, is added thereto, and the mixture is subjected to a polymerization reaction at 80° C. for 10 hours under a nitrogen atmosphere. Thereafter, hydrochloric acid is put into the mixture to decompose calcium carbonate, and then water-ishing is carried out.

In addition, wet classification is performed to screen elastomer particles, and vacuum-dried at 100° C. for 12 hours.

Thereafter, 150 parts of a dimethylsilicone oil is dissolved in 1000 parts of ethanol, and mixed with 100 parts of the elastomer particles under stirring. Then, ethanol in the solvent is evaporated using an evaporator and the residue is dried to obtain oil-treated elastomer particles a to f.

The oil-treated elastomer particles a to f are observed by the method as described above, and the volume particle diameter $D16_E$, the volume particle diameter $D50_E$, and the volume particle size distribution index $GSD_E$ ($D50_E/D16_E$) on the small diameter side are measured. The measurement results are shown in Table 4.

<Production of Fatty Acid Metal Salt Particles>

(Production of Zinc Stearate Particles (a) to (c))

1422 parts of stearic acid is added to 10000 parts of ethanol, and mixed together at a liquid temperature of 75° C. 507 parts of zinc hydroxide is gradually added to the mixture, stirred, and mixed for one hour after completion of the addition. Thereafter, the mixture is cooled to a liquid temperature of 20° C., and the product is separated by filtration to remove ethanol and the reaction residue. The collected solid product is dried at 150° C. for 3 hours using a heating type vacuum-drier. The dried product is collected from the drier and allowed to stand for cooling, and as a result, a solid product of zinc stearate is obtained. After the obtained solid product is milled using a jet mill, the milled product is classified using an ELBOW-JET Classifier (manufactured by Matsubo Corporation), thereby obtaining zinc stearate particles (a) to (c) having a desired volume particle diameter $D16_S$ and a desired volume particle diameter $D50_S$.

The obtained zinc stearate particles (a) to (c) are observed by the method as described above, and their volume particle diameter $D16_S$, the volume particle diameter $D50_S$, and the volume particle size distribution index $GSD_S$ ($D50_S/D16_S$) on the small diameter side are measured. The measurement results are shown in Table 5, provided that in Tables 5 and 6, zinc stearate particles are denoted as "ZnSt".

(Production of Zinc Laurate Particles)

1001 parts of lauric acid is added to 10000 parts of ethanol, and mixed together at a liquid temperature of 75° C. 507 parts of zinc hydroxide is gradually added to the mixture, stirred, and mixed for one hour after completion of the addition. Thereafter, the mixture is cooled to a liquid temperature of 20° C., and the product is separated by filtration to remove ethanol and the reaction residue. The collected solid product is dried at 150° C. for 3 hours using a heating type vacuum-drier. The dried product is collected from the drier and allowed to stand for cooling, and as a result, a solid product of zinc laurate is obtained. The obtained solid product is milled and classified by the same method as for the zinc stearate particles (a) to obtain zinc laurate particles having a desired volume particle diameter $D16_S$ and a desired volume particle diameter $D50_S$.

The obtained zinc laurate particles are observed by the method as described above, and the volume particle diameter $D16_S$, the volume particle diameter $D50_S$, and the volume particle size distribution index $GSD_S$ ($D50_S/D16_S$) on the small diameter side are measured. The measurement results are shown in Table 5, provided that in Tables 5 and 6, zinc laurate particles are denoted as "ZnRa".

[Production of Toner Particles A to C]

(Production of Polyester Resin Dispersion (1))

45 parts by mole of 1,9-nonanediol, 55 parts by mole of dodecane dicarboxylic acid, and 0.05 part by mole of dibutyltin oxide as a catalyst are added to a heated and dried three-necked flask, and the air in the flask is made an inert atmosphere by a nitrogen gas by a pressure reduction operation, and the mixture is stirred and refluxed by mechanic stirring at 180° C. for 2 hours. The mixture is slowly warmed to 230° C. under reduced pressure and stirred for 5 hours, and when the mixture became viscous, it is cooled in air, and the reaction is stopped to synthesize a polyester resin. The weight average molecular weight (Mw) of the obtained polyester resin is measured by gel permeation chromatography (in terms of polystyrene) and is found to be 25,000. Thereafter, 3,000 parts of the obtained polyester resin, 10,000 parts of ion-exchanged water, and 90 parts of sodium dodecylbenzenesulfonate as a surfactant are put into an emulsification tank of a high temperature/high pressure emulsifier (CAVITRON CD1010, slit: 0.4 mm), and then the mixture is heated and melted at 130° C., dispersed for 30 minutes at 10,000 rotations at a flow rate of 3 L/m at 110° C., and passed through a cooling tank to recover a crystalline polyester resin dispersion (high temperature/high pressure emulsifier (CAVITRON CD1010, slit: 0.4 mm, manufactured by CAVITRON), thereby obtaining a polyester resin dispersion (1).

(Preparation of Polyester Resin Dispersion (2))

15 parts by mole of polyoxyethylene(2,0)-2,2-bis(4-hydroxyphenyl)propane, 85 parts by mole of polyoxypropylene(2,2)-2,2-bis(4-hydroxyphenyl)propane, 10 parts by mole of terephthalic acid, 67 parts by mole of fumaric acid, 3 parts by mole of n-dodecenylsuccinic acid, and 20 parts by mole of trimellitic acid, and 0.05 parts by mole of dibutyltin oxide with respect to these acid components (total moles of terephthalic acid, n-dodecenylsuccinic acid, trimellitic acid, and fumaric acid) are put into a container, warmed while maintaining it under an inert atmosphere with introduction of a nitrogen gas into the container, and then subjected to a copolycondensation reaction at 150° C. to 230° C. for 12 hours to 20 hours. Thereafter, the mixture is slowly subjected to pressure reduction at 210° C. to 250° C., thereby synthesizing a polyester resin. The weight average molecular weight Mw of this resin is 65,000. Thereafter, 3,000 parts of the obtained polyester resin, 10,000 parts of ion-exchanged water, and 90 parts of sodium dodecylbenzenesulfonate as a surfactant are put into an emulsification tank of a high temperature/high pressure emulsifier (CAVITRON CD1010, slit: 0.4 mm), and then the mixture is heated and melted at 130° C., dispersed for 30 minutes at 10,000 rotations at a flow rate of 3 L/m at 110° C., and passed through a cooling tank to recover a polyester resin dispersion (high temperature/high pressure emulsifier (CAVITRON CD1010, slit: 0.4 mm, manufactured by CAVITRON), thereby obtaining a polyester resin dispersion (2).

[Preparation of Colorant Dispersion]

Cyan pigment (copper phthalocyanine, C. I. Pigment Blue 15:3, manufactured by Dainichiseika Color & Chemicals Mfg. Co., Ltd.): 1,000 parts Ionic surfactant NEOGEN RK (manufactured by Dai-Ichi Kogyo Seiyaku Co., Ltd.): 150 parts Ion-exchanged water: 4,000 parts The blending liquid above is mixed and dissolved, and dispersed for 1 hour using a high pressure counter collision type dispersing machine ULTIMAIZER (HJP30006, manufactured by Sugino Machine Ltd.), thereby obtaining a colorant dispersion having a volume average particle diameter of 180 nm and a solid content of 20%.

[Preparation of Release Agent Dispersion]

Paraffin wax HNP9 (melting temperature of 75° C.: manufactured by NIPPON SEIRO Co., Ltd.): 46 parts Cationic surfactant, NEOGEN RK (manufactured by Dai-Ichi Kogyo Seiyaku Co., Ltd.): 5 parts Ion-exchanged water: 200 parts The components above are heated to 100° C., sufficiently dispersed using ULTRATRAX T50 manufactured by IKA Japan K. K., and then subjected to a dispersion treatment using a pressure discharge type GAOLIN homogenizer, thereby obtaining a releasing agent dispersion having a volume average particle diameter of 200 nm and a solid content of 20.0%.

—Production of Toner Particles A—

Polyester resin dispersion (1): 33.2 parts

Polyester resin dispersion (2): 256.8 parts

Colorant dispersion: 27.4 parts

Release agent dispersion: 35 parts

The components above are put into a round-bottom stainless steel flask, and sufficiently mixed and dispersed using ULTRATRAX T50. Then, 0.20 parts of polyaluminum chloride is added thereto, the dispersion operation using ULTRATRAX T50 is continued. The flask is heated to 48° C. while being stirred in an oil bath for heating. After holding at 48° C. for 60 minutes, 70.0 parts of the polyester resin dispersion (2) is added to the flask. Thereafter, the pH in the system is adjusted to 8.0 using an aqueous sodium hydroxide solution having a concentration of 0.5 mol/L. Then, the stainless-steel flask is sealed and heated to 96° C. while being continuously stirred with a seal using magnetic force, followed by holding for 3 hours. After the reaction ended, the mixture is cooled, filtered, and sufficiently ished with ion-exchanged water. Then, solid-liquid separation is performed through Nutsche-type suction filtration. The obtained material is further redispersed using 1,000 parts of ion-exchanged water at 30° C., and stirred and ished at 300 rpm for 15 minutes. This operation is further repeated five times, and when the filtrate had a pH of 7.5 and an electrical conductivity of 7.0 μS/cm, solid-liquid separation is performed through Nutsche-type suction filtration using No. 5A filter paper. Next, vacuum drying is continued for 12 hours, thereby obtaining toner particles A. The obtained toner particles A are observed by the method as described above, and the volume particle diameter $D16_T$, the volume particle diameter $D50_T$, and the volume particle size distribution index $GSD_T$ ($D50_T/D16_T$) on the small diameter side are measured. Further, for the toner particles B and C as described below, the volume particle diameter $D16_T$, the volume particle diameter $D50_T$, and the volume particle size distribution index $GSD_T$ ($D50_T/D16_T$) on the small diameter side are measured in the same manner as for the toner particles A.

The measurement results are shown in Table 3.

—Production of Toner Particles B—

In the same manner as for the production of the toner particles A, except that the retention time at 48° C. for 60 minutes is changed to a retention time at 48° C. for 80 minutes in the production of the toner particles A, toner particle B are obtained.

—Production of Toner Particles C—

In the same manner as for the production of the toner particles A, except that the retention time at 48° C. for 60 minutes is changed to a retention time at 48° C. for 30 minutes in the production of the toner particles A, toner particle C are obtained.

[Production of External Additive (Silica Particles)]

150 parts of 25% aqueous ammonia is added dropwise to 150 parts of tetramethoxysilane at 30° C. over 5 hours in the presence of 100 parts of ion-exchanged water and 100 parts of 25% alcohol, and the mixture is stirred at 250 rpm. The silica sol suspension obtained by the reaction is centrifuged, and separated into wet silica gel, an alcohol, and aqueous ammonia, and the additionally separated wet silica gel is dried at 120° C. for 2 hours. Then, 100 parts of silica and 500 parts of ethanol are put into an evaporator, and the mixture is stirred for 15 minutes while maintaining the temperature at 40° C. Next, 10 parts of dimethyldimethoxysilane is added to 100 parts of silica, and the mixture is further stirred for 15 minutes. Lastly, the temperature is raised to 90° C., ethanol is dried off under reduced pressure, and the treated product is collected and further vacuum-dried at 120° C. for 30 minutes. The dried silica is pulverized to obtain silica particles having a number average particle diameter of 80 nm.

[Production of Toner of Example 11]

0.5 parts of the elastomer particles b, 0.4 parts of zinc stearate particles (a) as the fatty acid metal salt particles, and 3.6 parts of silica particles with respect to 100 parts of the toner particles A are mixed at 3,600 rpm for 10 minutes in a HENSCHEL MIXER to produce a toner of Example 11.

[Production of Toners of Examples 12 to 21 and Comparative Examples 11 and 12]

In the same manner as for the toner of Example 11, except that the species and the content of the toner particle, the species and the content of the elastomer particle, and the species and the content of the fatty acid metal salt particle are changed in accordance with Table 4, toners of Examples 12 to 21 and Comparative Examples 11 and 12 are produced.

Incidentally, for the elastomer particles a to f, the total content of oil in 1 g of the toner is calculated by the method as described above, and is found to be 15 mg, respectively.

[Production of Carrier]

Ferrite particles (average particle diameter of 50 μm, volume electric resistance of $3\times10^8$ Ω·cm): 100 parts Toluene: 14 parts Perfluorooctylethyl acrylate/dimethylaminoethyl methacrylate copolymer (copolymerization ratio of 90:10, Mw=50,000): 1.6 parts Carbon black (VXC-72, manufactured by Cabot Corporation): 0.12 parts The components except for ferrite particles among the components described above are dispersed for 10 minutes by a stirrer to prepare a coating film forming solution. This coating film forming solution and the ferrite particles are placed in a vacuum-deaeration kneader, and stirred at 60° C. for 30 minutes. Toluene is removed under reduced pressure, and a resin film is formed on the surface of the ferrite particles, thereby preparing a carrier. Further, the volume average particle diameter of the obtained carrier is 51 μm.

[Production of Developer]

The toner and the carrier as obtained above are put into a V-blender at a mass ratio of 5:95 and stirred for 20 minutes, thereby obtaining each of developers of Examples 11 to 21 and Comparative Examples 11 and 12.

The obtained developer is charged in DocuCentre Color 400 (manufactured by Fuji Xerox Co., Ltd.) and evaluated as follows.

[Evaluation of Image Defects]

(Evaluation of Streak-Shaped Image Defects)

By the following method, evaluation of the streak-shaped image defects due to a change in the posture of the cleaning blade is carried out.

1) DocuCentre Color 400 manufactured by Fuji Xerox Co., Ltd., equipped with the obtained developer, is left to stand in a low temperature/low humidity environment (15° C. and 20% RH) for 1 day, and then 100,000 sheets of rectangular patch (6 cm×1 cm) are continuously output to give an image density of 1%. Incidentally, the output of the rectangular patch is carried out such that the length direction of the patch is in parallel in the paper transporting direction.

2) Thereafter, DocuCentre Color 400 is left to stand in a high temperature/high humidity environment (30° C. and 85% RH) for 1 day, and then 100,000 sheets of rectangular patch (6 cm×20 cm) are continuously output in the same paper transporting direction as in 1) to give an image density of 80% in the non-image portion, relative to the image portion (the rectangular patch).

3) For the image obtained in 2), the images on every $1000^{th}$ sheet (100 sheets in total) are checked, and the number of sheets having occurrence of streak-shaped image defects is checked. The evaluation criteria are as follows. The obtained results are shown in Table 6.

—Evaluation Criteria for Streak-Shaped Image Defects—

G1 (A): Number of sheets having occurrence of the streak-shaped image defects due to a change in the posture of the cleaning blade≤1 sheet G2 (B): 1 sheet<Number of sheets having occurrence of the streak-shaped image defects due to a change in the posture of the cleaning blade≤3 sheets G3 (C): 3 sheets<Number of sheets having occurrence of the streak-shaped image defects due to a change in the posture of the cleaning blade≤5 sheets G4 (D): 5 sheets<Number of sheets having occurrence of the streak-shaped image defects due to a change in the posture of the cleaning blade (White Image Defects)

For evaluation of white image defects, the images having an image density of 80%, which are produced for the evaluation of the streak-shaped image defects above, on every $5000^{th}$ sheet, are checked, and the number of occurrences of white image defects is checked.

The evaluation criteria are as follows. The obtained results are shown in Table 6.

—Evaluation Criteria—

G1 (A): Number of occurrences of white image defects≤5 sheets

G2 (B): 5 sheets<Number of occurrences of white image defects≤10 sheets

G3 (C): 10 sheets<Number of occurrences of white image defects≤30 sheets

G4 (D): 30 sheets<Number of occurrences of white image defects≤50 sheets

TABLE 3

| Toner particles | | | |
|---|---|---|---|
| Type | $D50_T$ (μm) | $D16_T$ (μm) | $GSD_T$ |
| A | 5.8 | 4.83 | 1.20 |
| B | 6.5 | 5.0 | 1.30 |
| C | 3.8 | 3.0 | 1.27 |

TABLE 4

| Elastomer particles | | | |
|---|---|---|---|
| Type | $D50_E$ (μm) | $D16_E$ (μm) | $GSD_E$ |
| a | 0.5 | 0.3 | 1.67 |
| b | 1 | 0.6 | 1.67 |
| c | 5 | 3.5 | 1.43 |
| d | 10 | 7 | 1.43 |
| e | 30 | 24 | 1.25 |
| f | 40 | 30 | 1.33 |

TABLE 5

| Fatty acid metal salt particles | | | |
|---|---|---|---|
| Type | $D50_S$ (μm) | $D16_S$ (μm) | $GSD_S$ |
| ZnST (a) | 3.0 | 2.0 | 1.5 |
| ZnST (b) | 20 | 15 | 1.33 |
| ZnST (c) | 10 | 9.5 | 1.05 |
| ZnRa | 3.0 | 1.8 | 1.67 |

TABLE 6

| | Toner particles | | Elastomer particles | | Fatty acid metal salt particles | | | | | | Elastomer particles/ Fatty acid metal | Evaluation of image defects | |
|---|---|---|---|---|---|---|---|---|---|---|---|---|---|
| | Type | Content (parts) | Type | Content (parts) | Type | Content (parts) | $GSD_E/GSD_T$ | $D50_E/D50_T$ | $GSD_S/GSD_T$ | $D50_S/D50_T$ | salt particles (mass ratio) | Streak shape | White image |
| Example 1 | C | 100 | b | 0.5 | ZnST (a) | 0.3 | 1.32 | 0.26 | 1.18 | 0.79 | 1.67 | G2(B) | G3(C) |
| Example 2 | A | 100 | c | 0.5 | ZnST (a) | 0.3 | 1.19 | 0.86 | 1.25 | 0.52 | 1.67 | G1(A) | G1(A) |
| Example 3 | A | 100 | d | 0.5 | ZnST (a) | 0.3 | 1.19 | 1.72 | 1.25 | 0.52 | 1.67 | G1(A) | G1(A) |
| Example 4 | A | 100 | e | 0.5 | ZnST (a) | 0.3 | 1.04 | 5.17 | 1.25 | 0.52 | 1.67 | G2(B) | G2(B) |

TABLE 6-continued

| | Toner particles | | Elastomer particles | | Fatty acid metal salt particles | | | | | | Elastomer particles/ Fatty acid metal | Evaluation of image defects | |
|---|---|---|---|---|---|---|---|---|---|---|---|---|---|
| | Type | Content (parts) | Type | Content (parts) | Type | Content (parts) | $GSD_E/GSD_T$ | $D50_E/D50_T$ | $GSD_S/GSD_T$ | $D50_S/D50_T$ | salt particles (mass ratio) | Streak shape | White image |
| Example 5 | A | 100 | c | 0.5 | ZnRa | 0.3 | 1.19 | 0.86 | 1.39 | 0.52 | 1.67 | G2(B) | G1(A) |
| Example 6 | A | 100 | f | 0.5 | ZnST (a) | 0.3 | 1.11 | 6.90 | 1.25 | 0.52 | 1.67 | G3(C) | G2(B) |
| Example 7 | C | 100 | a | 0.5 | ZnST (a) | 1.0 | 1.32 | 0.13 | 1.18 | 0.79 | 0.5 | G2(B) | G3(C) |
| Example 8 | C | 100 | e | 0.5 | ZnST (a) | 0.3 | 0.96 | 4.62 | 1.15 | 0.46 | 1.67 | G3(C) | G2(B) |
| Example 9 | B | 100 | d | 0.5 | ZnST (b) | 0.3 | 1.10 | 1.54 | 1.03 | 3.08 | 1.67 | G3(C) | G2(B) |
| Example 10 | B | 100 | c | 0.5 | ZnST (c) | 0.3 | 1.19 | 0.86 | 0.88 | 1.72 | 1.67 | G3(C) | G2(B) |
| Example 11 | B | 100 | c | 0.1 | ZnST (a) | 0.6 | 1.19 | 0.86 | 1.25 | 0.52 | 0.17 | G3(C) | G2(B) |
| Comparative Example 1 | A | 100 | None | — | ZnST (a) | 0.3 | — | — | 1.25 | 0.52 | — | G4(D) | G4(D) |
| Comparative Example 2 | A | 100 | c | 0.5 | None | — | 1.19 | 0.86 | — | — | — | G4(D) | G4(D) |

From the evaluation results, it could be seen that in the present Examples, the streak-shaped image defects due to a change in the posture of the cleaning blade are inhibited, as compared with Comparative Examples.

Particularly, it could be seen that in Examples 11 to 15, having elastomer particles with a volume particle diameter $D50_E$ ranging from 1 μm to 30 μm, the streak-shaped image defects due to a change in the posture of the cleaning blade are further inhibited, as compared with Example 16 having elastomer particles with a volume particle diameter $D50_E$ of more than 30 μm.

It could be seen that in Example 12, in which the fatty acid metal salt particles are zinc stearate particles, the streak-shaped image defects due to a change in the posture of the cleaning blade are further inhibited, as compared with Example 5, in which the fatty acid metal salt particles are zinc laurate particles.

It could be seen that in Examples 12 and 13 satisfying $GSD_E/GSD_T \geq 1$ and $GSD_S/GSD_T \geq 1$, the streak-shaped image defects due to a change in the posture of the cleaning blade are further inhibited, as compared with Examples 18 and 20 satisfying $GSD_E/GSD_T < 1$ or $GSD_S/GSD_T < 1$.

Furthermore, it could be seen that in Examples 2 and 3 satisfying $0.8 \leq D50_E/D50_T \leq 2$ and $0.16 \leq D50_S/D50_T \leq 3$, the streak-shaped image defects due to a change in the posture of the cleaning blade are further inhibited, as compared with Examples 11, 14, 16, 18, and 19 satisfying, $D50_E/D50_T < 0.8$, $D50_E/D50_T > 2$, $D50_S/D50_T < 0.16$, or $D50_S/D50_T > 3$.

In addition, it could be seen that in the present Examples, the white image defects are also inhibited, as compared with Comparative Examples.

From above, it could be seen that by incorporating both of elastomer particles and fatty acid metal salt particles in a toner, a toner for developing an electrostatic charge image in which the streak-shaped image defects due to a change in the posture of the cleaning blade are inhibited, is obtained, even when a low-intensity image is formed over a long period of time and then a high-intensity image is formed.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and there equivalents.

What is claimed is:

1. A toner for developing an electrostatic charge image, comprising:

a toner particle containing a binder resin;

a particle adhering to a surface of the toner particle; and an elastomer particle containing one or more species of oil, wherein a volume particle size distribution index $GSD_T$ ($D50_T/D16_T$) on a small diameter side of the toner particle and a volume particle size distribution index $GSD_E$ ($D50_E/D16_E$) on a small diameter side of the elastomer particle satisfy Formula (1):

$$GSD_E/GSD_T \geq 1 \quad \text{Formula (1):}$$

wherein in a volume particle size distribution of the toner particle, a particle diameter at which a cumulative percentage drawn from the small diameter side becomes 16% is defined as a volume particle diameter $D16_T$, and a particle diameter at which the cumulative percentage drawn from the small diameter side becomes 50% is defined as a volume particle diameter $D50_T$; and in a volume particle size distribution of the elastomer particle, the particle diameter at which a cumulative percentage drawn from the small diameter side becomes 16% is defined as a volume particle diameter $D16_E$, and a particle diameter at which the cumulative percentage drawn from the small diameter side becomes 50% is defined as a volume particle diameter $D50_E$.

2. The toner for developing an electrostatic charge image according to claim 1, wherein the volume particle diameter $D50_T$ and the volume particle diameter $D50_E$ satisfy Formula (2):

$$0.8 \leq D50_E/D50_T \leq 2. \quad \text{Formula (2):}$$

3. The toner for developing an electrostatic charge image according to claim 1, wherein a content of the elastomer particle is from 0.05 parts by mass to 5 parts by mass with respect to 100 parts by mass of the toner particle.

4. The toner for developing an electrostatic charge image according to claim 1, wherein a total content of oils in the elastomer particle is from 0.01 mg to 100 mg with respect to 1 g of the toner.

5. The toner for developing an electrostatic charge image according to claim 1, wherein a specific surface area of the elastomer particle before containing the oil is from 0.1 $m^2/g$ to 25 $m^2/g$.

6. The toner for developing an electrostatic charge image according to claim 1, wherein the oil is a silicone oil.

7. The toner for developing an electrostatic charge image according to claim 1, wherein the toner including a particle of fatty acid metal salt.

8. The toner for developing an electrostatic charge image according to claim 7, wherein the toner including a particle of zinc stearate.

9. The toner for developing an electrostatic charge image according to claim 7, wherein a volume particle size distribution index $GSD_S$ ($D50_S/D16_S$) on a small diameter side of the fatty acid metal salt particle satisfy Formula (3):

$$GSD_S/GSD_T \geq 1 \quad \text{Formula (3):}$$

wherein in a volume particle size distribution of the fatty acid metal salt particle, a particle diameter at which a cumulative percentage drawn from the small diameter side becomes 16% is defined as a volume particle diameter $D16_S$, and a particle diameter at which the cumulative percentage drawn from the small diameter side becomes 50% is defined as a volume particle diameter $D50_S$.

10. The toner for developing an electrostatic charge image according to claim 9, wherein the volume particle diameter $D50_T$, the volume particle diameter $D50_E$ and the volume particle diameter $D50_S$ satisfy Formula (4) and (5):

$$0.8 \leq D50_E/D50_T \leq 2, \quad \text{Formula (4):}$$

$$0.16 \leq D50_S/D50_T \leq 3. \quad \text{Formula (5):}$$

11. An electrostatic charge image developer comprising the toner for developing an electrostatic charge image according to claim 1.

12. A toner cartridge comprising the toner for developing an electrostatic charge image according to claim 1, and is attachable to or detachable from an image forming apparatus.

13. A process cartridge comprising a developing device, which includes the electrostatic charge image developer according to claim 11, for developing an electrostatic charge image formed on an image holding member as a toner image using the electrostatic charge image developer, the process cartridge being attachable to or detachable from an image forming apparatus.

14. An image forming apparatus comprising:

an image holding member;

a charging roller for charging the surface of the image holding member;

an exposure device for forming an electrostatic charge image on a surface of the charged image holding member;

a developing device including the electrostatic charge image developer according to claim 11, for developing the electrostatic charge image formed on a surface of the image holding member as a toner image by the electrostatic charge image developer;

a transfer roller for transferring the toner image formed on the surface of the image holding member onto a surface of a recording medium;

a cleaning device having a cleaning blade for cleaning the surface of the image holding member; and a fixing device for fixing the toner image transferred onto the surface of the recording medium.

15. An image forming method comprising:

charging a surface of an image holding member;

forming an electrostatic charge image on the surface of the charged image holding member;

developing the electrostatic charge image formed on the surface of the image holding member as a toner image by the electrostatic charge image developer according to claim 11;

transferring the toner image formed on the surface of the image holding member onto a surface of a recording medium;

cleaning the surface of the image holding member using a cleaning blade; and fixing the toner image transferred onto the surface of the recording medium.

* * * * *